US010808714B2

(12) United States Patent
Ishii et al.

(10) Patent No.: US 10,808,714 B2
(45) Date of Patent: Oct. 20, 2020

(54) TURBOFAN

(71) Applicant: DENSO CORPORATION, Kariya, Aichi-pref. (JP)

(72) Inventors: Fumiya Ishii, Kariya (JP); Shuzo Oda, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 132 days.

(21) Appl. No.: 15/777,006

(22) PCT Filed: Oct. 20, 2016

(86) PCT No.: PCT/JP2016/081099
§ 371 (c)(1),
(2) Date: May 17, 2018

(87) PCT Pub. No.: WO2017/090348
PCT Pub. Date: Jun. 1, 2017

(65) Prior Publication Data

US 2018/0355882 A1 Dec. 13, 2018

(30) Foreign Application Priority Data

Nov. 23, 2015 (JP) ..... 2015-228268

(51) Int. Cl.
*F04D 29/28* (2006.01)
*F04D 29/68* (2006.01)
(Continued)

(52) U.S. Cl.
CPC ..... *F04D 29/281* (2013.01); *F04D 17/16* (2013.01); *F04D 29/626* (2013.01); *F04D 29/66* (2013.01); *F04D 29/681* (2013.01); *F04D 25/06* (2013.01)

(58) Field of Classification Search
CPC ..... F04D 29/281; F04D 29/282; F04D 29/28; F04D 29/682
See application file for complete search history.

(56) References Cited

U.S. PATENT DOCUMENTS 3,221,398 A * 12/1965 Mayne ..... F04D 29/281 29/889.4
4,470,753 A * 9/1984 Witzel ..... B60H 1/00471 415/116
(Continued)

FOREIGN PATENT DOCUMENTS

CN 1078023 A 11/1993
CN 1932301 A 3/2007
(Continued)

OTHER PUBLICATIONS

U.S. Appl. No. 15/777,041, filed May 17, 2018, Ishii et al.

*Primary Examiner* — Courtney D Heinle
*Assistant Examiner* — Andrew Thanh Bui
(74) *Attorney, Agent, or Firm* — Harness, Dickey & Pierce, P.L.C.

(57) ABSTRACT

A fan main body member of a turbofan has multiple blades disposed around a fan axial center, a shroud ring coupled to each of the blades, and a fan hub portion coupled to each of the blades on a side opposite from the shroud ring. An other end side plate of the turbofan is joined to each of the other side blade end portions of the blade in a state of being fitted to the radially outer side of the fan hub portion. A fitting gap between the other end side plate and the fan hub portion is formed such that an outflow velocity of air when air passes through the fitting gap and outflows is reduced as compared to when air passes through a virtual reference gap that corresponds to the fitting gap and outflows.

15 Claims, 10 Drawing Sheets

(51) Int. Cl.

| | |
|---|---|
| ***F04D 29/62*** | (2006.01) |
| ***F04D 17/16*** | (2006.01) |
| ***F04D 29/66*** | (2006.01) |
| ***F04D 25/06*** | (2006.01) |

(56) References Cited

U.S. PATENT DOCUMENTS 5,478,206 A * 12/1995 Prahst ..... F04D 29/023
416/186 R
6,755,615 B2 * 6/2004 Chapman ..... F04D 29/023
415/206

FOREIGN PATENT DOCUMENTS

DE 4427115 C1 * 4/1995 ..... F04D 29/023
JP 4317676 B2 8/2009

* cited by examiner

TURBOFAN

CROSS REFERENCE TO RELATED APPLICATIONS

This application is a U.S. National Phase Application under 35 U.S.C. 371 of International Application No. PCT/JP2016/081099 filed on Oct. 20, 2016 and published in Japanese as WO 2017/090348 A1 on Jun. 1, 2017. This application is based on and claims the benefit of priority from Japanese Patent Application No. 2015-228268 filed on Nov. 23, 2015. The entire disclosures of all of the above applications are incorporated herein by reference.

TECHNICAL FIELD

The present disclosure relates to a turbofan applied to a blower.

BACKGROUND ART

For example, Patent Literature 1 discloses a turbofan included in conventional art. The turbofan disclosed in Patent Literature 1 is a fan for an air conditioner. Specifically, the turbofan of Patent Literature 1 is a closed turbofan in which blades are surrounded by a shroud ring and a main plate among various turbofans.

In the turbofan of Patent Literature 1, among three components including the shroud ring which is a basic configuration of the closed turbofan, multiple blades, and a fan main body including a fan hub portion and a main plate, the fan main body and the blade are integrally molded. In addition, the shroud ring is molded as a separate component from the fan main body. The turbofan of Patent Literature 1 is formed by joining the shroud ring to the fan main body. Furthermore, in the turbofan of Patent Literature 1, weldability when joining the shroud ring to the fan main body is improved.

PRIOR ART LITERATURE

Patent Literature

Patent Literature 1: JP 4317676 B

SUMMARY OF INVENTION

In closed turbofans such as those described in Patent Literature 1, the inventor considered a configuration of molded components different from the turbofan of Patent Literature 1. Specifically, in the configuration considered by the inventor, the fan main body is formed by being divided into a fan hub portion on a radially inner side and a lower side plate on a radially outer side. In addition, the lower side plate is provided on the opposite side from the blades as the shroud ring. Furthermore, the shroud ring, the multiple blades, and the fan hub portion are integrally molded to form the fan main body member that serves as one molded component. On the other hand, the lower side plate is molded as a component separated from the fan main body member, and assembled to the fan main body member after the molding.

For example, in a turbofan in which the fan hub portion and the lower side plate are molded as separate components, there is a possibility that a minute gap is formed between the fan hub portion and the lower side plate due to a joining play between the fan hub portion and the lower side plate. In addition, as a result of detailed investigation by the inventor, it was found that a backflow phenomenon in which the air blown out from the turbofan flows into the inter-blade flow path between the blades through the gap is exhibited in accordance with the rotation of the turbofan when the gap is formed. The backflow phenomenon causes the air flow to be separated from the surface of the lower side plate in the inter-blade flow path, resulting in a situation in which the performance of the turbofan deteriorates. For example, the separation of the air flow tends to occur as the flow velocity when the air flows out from the gap between the fan hub portion and the lower side plate is higher.

From the above-described viewpoint, an object of the present disclosure is to provide a turbofan which is capable of preventing an air flow from being separated from a lower side plate due to an air inflow from a gap between a fan hub portion and the lower side plate to an inter-blade flow path.

To achieve the above object(s), in one aspect of the present disclosure, a turbofan of the present disclosure is a turbofan which is applied to a blower and which blows air by rotating about a fan axial center, including a fan main body member including a plurality of blades disposed around the fan axial center, a shroud ring having formed therein an intake hole into which air is suctioned, the shroud ring being provided on one side in an axial direction of the fan axial center with respect to the plurality of blades and being coupled to each of the plurality of blades, and a fan hub portion which is supported so as to be rotatable about the fan axial center with respect to a non-rotating member of the blower and which is coupled to each of the plurality of blades on a side opposite from the shroud ring, and an other end side plate that, in a state of being fitted to a radially outer side of the fan hub portion, is joined to an other side blade end portion included in each of the plurality of blades, the other side blade end portions of the plurality of blades being on an other side which is opposite to the one side in the axial direction, where the plurality of blades form an inter-blade flow path, through which air flows, between adjacent ones of the plurality of blades, the other end side plate forms a fitting gap between the other end side plate and the fan hub portion in a radial direction of the fan axial center, and assuming a virtual reference gap that corresponds to the fitting gap, in which a length of the reference gap in the axial direction is defined as an axial thickness of the other end side plate in the axial direction, a passage cross-sectional area of the reference gap as a passage through which air passes is constant at any location in the axial direction and equal to a minimum passage cross-sectional area of the fitting gap in the axial direction, and a cross-sectional shape of the reference gap in a cross-section orthogonal to the fan axial center is uniform at any location in the axial direction, then the fitting gap is formed such that an outflow velocity of air on a side opposite from the inter-blade flow path with respect to the other end side plate passes through the fitting gap to outflow to the inter-blade flow path is reduced as compared with an outflow velocity when the air passes through the reference gap to outflow to the inter-blade flow path.

As described above, the fitting gap is formed such that the outflow velocity when the air on a side opposite from the inter-blade flow path side with respect to the other end side plate passes through the fitting gap to outflow to the inter-blade flow path is reduced as compared with the outflow velocity when the air passes through the reference gap to outflow to the inter-blade flow path. Therefore, a momentum of the air when flowing into the inter-blade flow path from the fitting gap is restricted as compared with a momentum when the air flows into the inter-blade flow path from the reference gap. Therefore, the air flow can be prevented from being separated from the other end side plate (that is, the lower side plate) due to an air inflow from the fitting gap into the inter-blade flow path.

DESCRIPTION OF EMBODIMENTS

Figure 1:
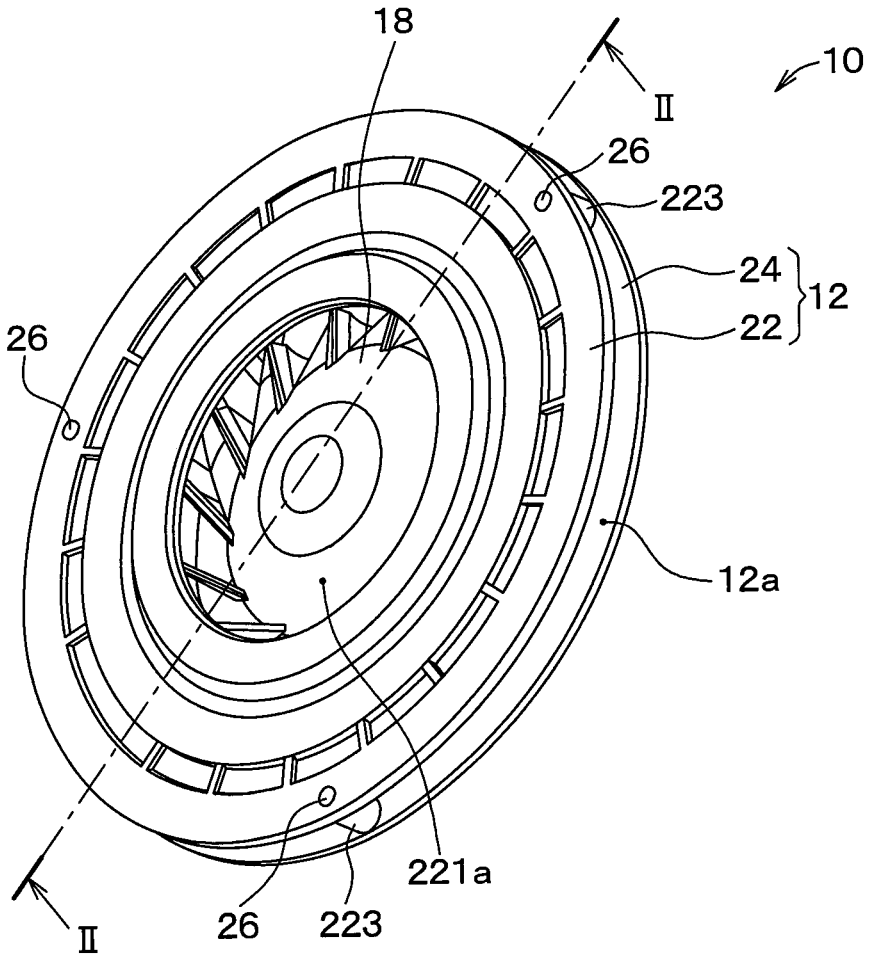
FIG. 1 is a perspective view illustrating an appearance of a blower in a first embodiment.

Hereinafter, embodiments of the present disclosure will be described with reference to the drawings. In addition, the same reference numerals are attached to the same or equivalent portions in each of the following embodiments including other embodiments described later.

First Embodiment

Figure 2:
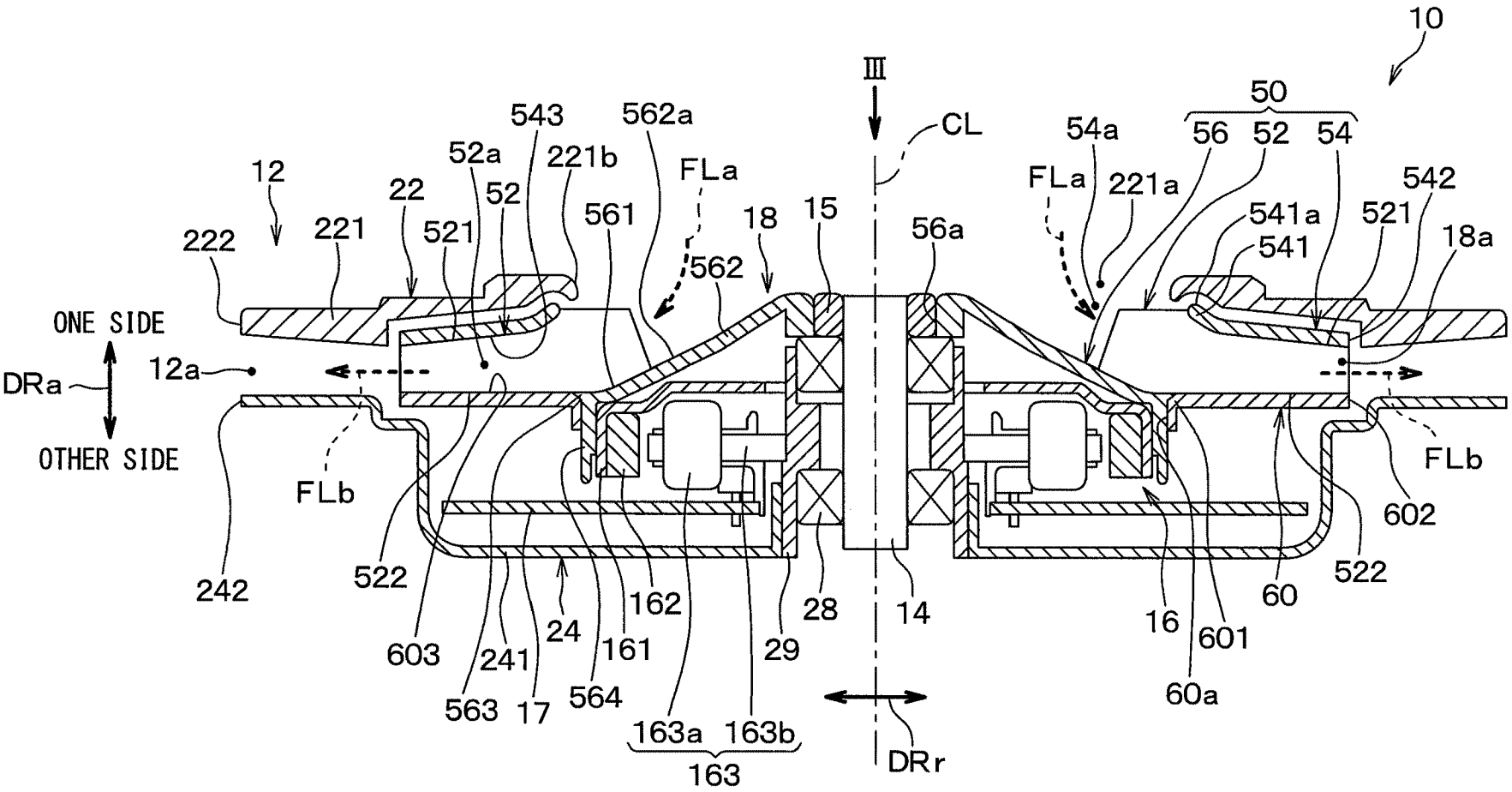
FIG. 2 is an axial cross-sectional view of the blower taken along a plane including a fan axial center, that is, a cross-sectional view taken along line II-II of FIG. 1.

FIG. 1 is a perspective view illustrating an appearance of a blower 10 in a first embodiment. In addition, FIG. 2 is an axial cross-sectional view of the blower 10 taken along a plane including a fan axial center CL, that is, a cross-sectional view taken along line II-II of FIG. 1. An arrow DRa in FIG. 2 indicates an axial direction DRa of the fan axial center CL, that is, a fan axial center direction DRa. In addition, an arrow DRr in FIG. 2 indicates a radial direction DRr of the fan axial center CL, that is, a fan radial direction DRr.

As illustrated in FIGS. 1 and 2, the blower 10 is a centrifugal blower, specifically, a turbo type blower. The blower 10 includes a casing 12, a rotating shaft 14, a rotating shaft housing 15, an electric motor 16, an electronic board 17, a turbofan 18, a bearing 28, a bearing housing 29 and the like which are housings of the blower 10.

The casing 12 protects the electric motor 16, the electronic board 17, and the turbofan 18 from dust and dirt on the outer side of the blower 10. Therefore, the casing 12 accommodates the electric motor 16, the electronic board 17, and the turbofan 18. In addition, the casing 12 includes a first case member 22 and a second case member 24.

The first case member 22 is made of resin, for example, and has a diameter larger than that of the turbofan 18 and has a substantially disk shape. The first case member 22 includes a first cover portion 221, a first circumferential edge portion 222, and multiple supports 223.

The first cover portion 221 is disposed on one side in the fan axial center direction DRa with respect to the turbofan 18 and covers one side of the turbofan 18. Here, covering the turbofan 18 is to cover at least a portion of the turbofan 18.

An air suction port 221*a* which penetrates the first cover portion 221 in the fan axial center direction DRa is provided on the inner circumferential side of the first cover portion 221, and the air is suctioned to the turbofan 18 through the air suction port 221*a*. In addition, the first cover portion 221 has a bell mouth portion 221*b* that forms a circumferential edge of the air suction port 221*a*. The bell mouth portion 221*b* smoothly guides the air that flows from the outer side of the blower 10 to the air suction port 221*a* into the air suction port 221*a*.

As illustrated in FIGS. 1 and 2, the first circumferential edge portion 222 forms a circumferential edge of the first case member 22 around the fan axial center CL. Each of the multiple supports 223 protrudes from the first cover portion 221 to the inside of the casing 12 in the fan axial center direction DRa. In addition, the support 223 has a thick cylindrical shape having a central axis parallel to the fan axial center CL. A screw hole through which a screw 26 that bonds the first case member 22 and the second case member 24 is inserted is provided on the inside of the support 223.

Each of the supports 223 of the first case member 22 is disposed on the outer side of the turbofan 18 in the fan radial direction DRr. In addition, the first case member 22 and the second case member 24 are joined by the screw 26 inserted into the support 223 in a state where a tip end of the support 223 abuts against the second case member 24.

The second case member 24 has a substantially disk shape having substantially the same diameter as that of the first case member 22. The second case member 24 is made of metal, such as iron or stainless steel, or resin, and also functions as a motor housing for covering the electric motor 16 and the electronic board 17. The second case member 24 includes a second cover portion 241 and a second circumferential edge portion 242.

The second cover portion 241 is disposed on an other side in the fan axial center direction DRa with respect to the turbofan 18 and the electric motor 16, and covers an other side of the turbofan 18 and the electric motor 16. The second circumferential edge portion 242 forms the circumferential edge of the second case member 24 around the fan axial center CL.

The first circumferential edge portion 222 and the second circumferential edge portion 242 form an air blowing portion for blowing the air in the casing 12. In addition, the first circumferential edge portion 222 and the second circumferential edge portion 242 are provided between the first circumferential edge portion 222 and the second circumferential edge portion 242 in the fan axial center direction DRa such that an air outlet 12*a* for blowing out the air blown out from the turbofan 18 is provided.

Specifically, the air outlet 12*a* is provided on a fan side surface of the blower 10, and opens over the entire circumference of the casing 12 around the fan axial center CL and blows out the air from the turbofan 18. In addition, since the air blowing out from the casing 12 is obstructed by the support 223 at the location where the support 223 is provided, a case where the air outlet 12*a* is open over the entire circumference of the casing 12 has a meaning including a case where the air outlet 12*a* is open substantially over the entire circumference.

Each of the rotating shaft 14 and the rotating shaft housing 15 is made of a metal, such as iron, stainless steel, or brass. As illustrated in FIG. 2, the rotating shaft 14 is a columnar bar member and pressed-fitted into the rotating shaft housing 15 and an inner ring of the bearing 28, respectively. Therefore, the rotating shaft housing 15 is fixed to the rotating shaft 14 and the inner ring of the bearing 28. Further, an outer ring of the bearing 28 is fixed by press-fitting or the like to the bearing housing 29. The bearing housing 29 is made of a metal, such as aluminum alloy, brass, iron, or stainless steel, for example, and is fixed to the second cover portion 241.

Therefore, the rotating shaft 14 and the rotating shaft housing 15 are supported via the bearing 28 with respect to the second cover portion 241. In other words, the rotating shaft 14 and the rotating shaft housing 15 are rotatable about the fan axial center CL with respect to the second cover portion 241.

At the same time, the rotating shaft housing 15 is fitted into an inner circumferential hole 56*a* of a fan hub portion 56 of the turbofan 18 in the casing 12. For example, the rotating shaft 14 and the rotating shaft housing 15 are insert-molded in a fan main body member 50 of the turbofan 18 in a state where the rotating shaft 14 and the rotating shaft housing 15 are mutually fixed in advance. Accordingly, the rotating shaft 14 and the rotating shaft housing 15 are coupled to the fan hub portion 56 of the turbofan 18 so as to be relatively non-rotatable. In other words, the rotating shaft 14 and the rotating shaft housing 15 rotate integrally with the turbofan 18 about the fan axial center CL.

The electric motor 16 is an outer rotor type brushless DC motor. The electric motor 16 together with the electronic board 17 is disposed between the fan hub portion 56 of the turbofan 18 and the second cover portion 241 in the fan axial center direction DRa. In addition, the electric motor 16 includes a motor rotor 161, a rotor magnet 162, and a motor stator 163. The motor rotor 161 is made of a metal, such as a steel plate, and for example, a motor rotor 161 is provided by press-forming the steel plate.

The rotor magnet 162 is a permanent magnet, and is made of a rubber magnet containing ferrite, neodymium, or the like. The rotor magnet 162 is integrally fixed to the motor rotor 161. Further, the motor rotor 161 is fixed to the fan hub portion 56 of the turbofan 18. In other words, the motor rotor 161 and the rotor magnet 162 rotate integrally with the turbofan 18 about the fan axial center CL.

The motor stator 163 includes a stator coil 163*a* and a stator core 163*b* which are electrically connected to the electronic board 17. The motor stator 163 is disposed on a radially inner side with a minute gap from the rotor magnet 162. In addition, the motor stator 163 is fixed to the second cover portion 241 of the second case member 24 via the bearing housing 29.

In the electric motor 16 configured in this manner, when the stator coil 163*a* of the motor stator 163 is electrically conducted from an external power source, a change in magnetic flux is generated in the stator core 163*b* by the stator coil 163*a*. In addition, the change in magnetic flux in the stator core 163*b* generates a force which pulls the rotor magnet 162. Since the motor rotor 161 is fixed to the rotating shaft 14 which is rotatably supported by the bearing 28, the motor rotor 161 receives the force which pulls the rotor magnet 162 and performs a rotational motion about the fan axial center CL. In other words, the electric motor 16 is electrically conducted to rotate the turbofan 18, to which the motor rotor 161 is fixed, about the fan axial center CL.

Figure 3:
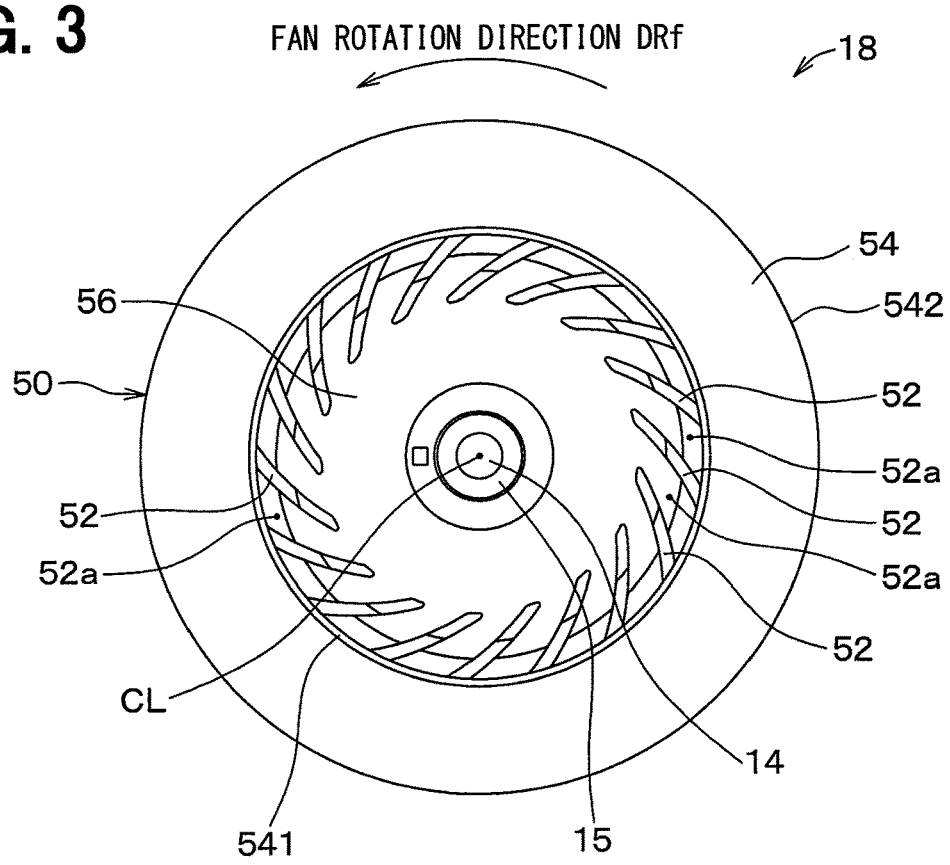
FIG. 3 is a view illustrating a turbofan, a rotating shaft, and a rotating shaft housing extracted from the view taken in the direction of an arrow III in FIG. 2.

As illustrated in FIGS. 2 and 3, the turbofan 18 is an impeller applied to the blower 10. The turbofan 18 rotates about the fan axial center CL in a predetermined fan rotation direction DRf to blow the air. In other words, as the turbofan 18 rotates about the fan axial center CL, the air is suctioned from one side in the fan axial center direction DRa as indicated by an arrow FLa via the air suction port 221*a*. In addition, the turbofan 18 blows out the suctioned air as indicated by an arrow FLb to the outer circumferential side of the turbofan 18.

Specifically, the turbofan 18 of the present embodiment has the fan main body member 50 and an other end side plate 60. In addition, the fan main body member 50 includes multiple blades 52, a shroud ring 54, and a fan hub portion 56. The fan main body member 50 is made of a resin, for example, and is provided by one injection molding. Therefore, the multiple blades 52, the shroud ring 54, and the fan hub portion 56 are integrally provided, and any of the multiple blades 52, the shroud ring 54, and the fan hub portion 56 is also formed of a resin similar to the fan main body member 50. In other words, since the fan main body member 50 is an integrally molded product, there is no joining portion for joining both of the multiple blades 52 and the shroud ring 54 to each other by welding or the like. In addition, between the multiple blades 52 and the fan hub portion 56, there is no joining portion for joining the multiple blades 52 and the fan hub portion 56 to each other by welding or the like.

The multiple blades 52 are disposed around the fan axial center CL. Specifically, the multiple blades 52, that is, the fan blades 52 are disposed in parallel in the circumferential direction of the fan axial center CL with an interval at which the air flows between the blades.

In addition, each of the blades 52 includes a one side blade end portion 521 provided on the one side in the fan axial center direction DRa of the blade 52, and an other side blade end portion 522 provided on the other side opposite to the one side in the fan axial center direction DRa of the blade 52.

Figure 4:
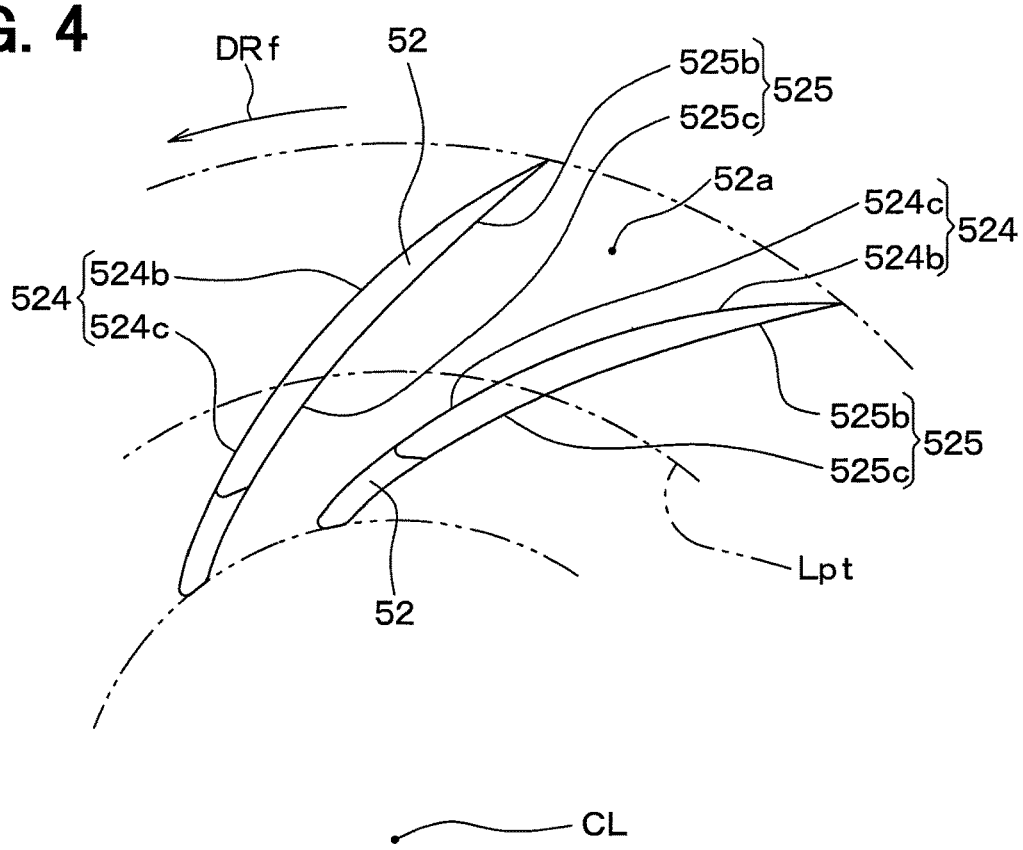
FIG. 4 is a view illustrating two blades adjacent to each other selected from multiple blades of a turbofan in the first embodiment, and is a view in which the two blades are viewed from one side of the fan axial center direction.

In addition, as illustrated in FIG. 4, each of the multiple blades 52 has a positive pressure surface 524 and a negative pressure surface 525 that form a blade shape. In addition, the multiple blades 52 form an inter-blade flow path 52*a* through which the air flows between the blades 52 adjacent to each other among the multiple blades 52. In other words, between the positive pressure surface 524 of one of the two adjacent blades 52 among the multiple blades 52 and the negative pressure surface 525 of the other one, the inter-blade flow path 52*a* is provided.

As illustrated in FIGS. 2 and 3, the shroud ring 54 has a shape which expands in a disk shape in the fan radial direction DRr. In addition, an intake hole 54*a* through which the air from the air suction port 221*a* of the casing 12 is suctioned as indicated by the arrow FLa is provided in the inner circumferential side of the shroud ring 54. Therefore, the shroud ring 54 has an annular shape.

Further, the shroud ring 54 has a ring inner circumferential end portion 541 and a ring outer circumferential end portion 542. The ring inner circumferential end portion 541 is an end portion provided on the inside of the shroud ring 54 in the fan radial direction DRr and forms the intake hole 54*a*. Further, the ring outer circumferential end portion 542 is an end portion provided on the outer side of the shroud ring 54 in the fan radial direction DRr.

Further, the shroud ring 54 is provided on one side in the fan axial center direction DRa, that is, on the air suction port 221*a* with respect to the multiple blades 52. At the same time, the shroud ring 54 is coupled to each of the multiple blades 52. In other words, the shroud ring 54 is coupled to each of the blades 52 in the one side blade end portion 521.

As illustrated in FIGS. 2 and 3, since the fan hub portion 56 is fixed via the rotating shaft housing 15 to the rotating shaft 14 rotatable about the fan axial center CL, the fan hub portion 56 is rotatably supported about the fan axial center CL with respect to the casing 12 that serves as a non-rotating member of the blower 10.

Further, the fan hub portion 56 is coupled to each of the multiple blades 52 on the side opposite to the shroud ring 54 side. Specifically, the entire blade coupling portion 561 coupled to the blade 52 in the fan hub portion 56 is provided on the inside of the entire shroud ring 54 in the fan radial direction DRr. In other words, the fan hub portion 56 is coupled to each of the blades 52 at a portion closer to the inner side in the fan radial direction DRr of the other side blade end portion 522. Therefore, since the multiple blades 52 also serve as a coupling rib for joining the fan hub portion 56 and the shroud ring 54 so as to bridge the fan hub portion 56 and the shroud ring 54, the multiple blades 52, the fan hub portion 56, and the shroud ring 54 can be integrally molded.

Further, the fan hub portion 56 has a hub guide surface 562*a* for guiding the air flow on the inside of the turbofan 18. The hub guide surface 562*a* is a curved surface that expands in the fan radial direction DRr and guides the air flow suctioned into the air suction port 221*a* and directed toward the fan axial center direction DRa so as to be directed outward in the fan radial direction DRr.

In other words, the fan hub portion 56 has a hub guide portion 562 having the hub guide surface 562*a*. In addition, the hub guide portion 562 forms the hub guide surface 562*a* on one side of the hub guide portion 562 in the fan axial center direction DRa.

In addition, in order to fix the fan hub portion 56 to the rotating shaft 14, an inner circumferential hole 56*a* which penetrates the fan hub portion 56 in the fan axial center direction DRa is provided on the inner circumferential side of the fan hub portion 56.

Further, the fan hub portion 56 has a hub outer circumferential end portion 563 and an annular extension portion 564. The hub outer circumferential end portion 563 is an end portion provided on the outer side of the fan hub portion 56 in the fan radial direction DRr. Specifically, the hub outer circumferential end portion 563 is an end portion that forms the circumferential edge of the hub guide portion 562.

The annular extension portion 564 is a cylindrical rib and extends from the hub outer circumferential end portion 563 to the other side in the fan axial center direction DRa (that is, the side opposite to the air suction port 221*a* side). The motor rotor 161 is fitted and stored on the inner circumferential side of the annular extension portion 564. In other words, the annular extension portion 564 functions as a rotor storage portion that stores the motor rotor 161. In addition, the annular extension portion 564 is fixed to the motor rotor 161, the fan hub portion 56 is fixed to the motor rotor 161.

The other end side plate 60 has a shape that expands in a disk shape in the fan radial direction DRr. In addition, a side plate fitting hole 60*a* which penetrates the other end side plate 60 in the thickness direction is provided on the inner circumferential side of the other end side plate 60. Therefore, the other end side plate 60 has an annular shape. The other end side plate 60 is, for example, a resin molded product molded separately from the fan main body member 50.

In addition, the other end side plate 60 is joined to each of the other side blade end portions 522 of the multiple blades 52 in a state of being fitted to the outer side of the fan hub portion 56 in the fan radial direction DRr. The other end side plate 60 and the blade 52 are joined to each other, for example, by vibration welding or thermal welding. Therefore, from the viewpoint of the weldability of the other end side plate 60 and the blade 52 by welding, it is preferable that the material of the other end side plate 60 and the fan main body member 50 is a thermoplastic resin, and more specifically, the same material is preferable.

By joining the other end side plate 60 to the blade 52 in this manner, the turbofan 18 is completed as a closed fan. The closed fan is a turbofan of which both sides in the fan axial center direction DRa of the inter-blade flow path 52*a* provided between the multiple blades 52 are covered with the shroud ring 54 and the other end side plate 60. In other words, the shroud ring 54 has a ring guide surface 543 which faces the inter-blade flow path 52*a* and guides the air flow in the inter-blade flow path 52*a*. In addition, the other end side plate 60 has a side plate guide surface 603 which faces the inter-blade flow path 52*a* and guides the air flow in the inter-blade flow path 52*a*.

The side plate guide surface 603 faces the ring guide surface 543 across the inter-blade flow path 52*a* and is disposed on the outside in the fan radial direction DRr with respect to the hub guide surface 562*a*. In addition, the side plate guide surface 603 plays a role of smoothly leading the air flow along the hub guide surface 562*a* to the air outlet 18*a*. Therefore, each of the hub guide surface 562*a* and the side plate guide surface 603 forms a part and an other part of the virtual curved surface three-dimensionally curved. In other words, the hub guide surface 562*a* and the side plate guide surface 603 form one curved surface that is not bent at the boundary between the hub guide surface 562*a* and the side plate guide surface 603.

In addition, the other end side plate 60 has a side plate inner circumferential end portion 601 and a side plate outer circumferential end portion 602. The side plate inner circumferential end portion 601 is an end portion provided on the inner side of the other end side plate 60 in the fan radial direction DRr and forms a side plate fitting hole 60*a*. In addition, the side plate outer circumferential end portion 602 is an end portion provided on the outer side in the fan radial direction DRr of the other end side plate 60.

The side plate outer circumferential end portion 602 and the ring outer circumferential end portion 542 are disposed to be separated from each other in the fan axial center direction DRa. In addition, the side plate outer circumferential end portion 602 and the ring outer circumferential end portion 542 are provided by forming the air outlet 18*a* from which the air which passes through the inter-blade flow path 52*a* blows out between the side plate outer circumferential end portion 602 and the ring outer circumferential end portion 542.

Figure 5:
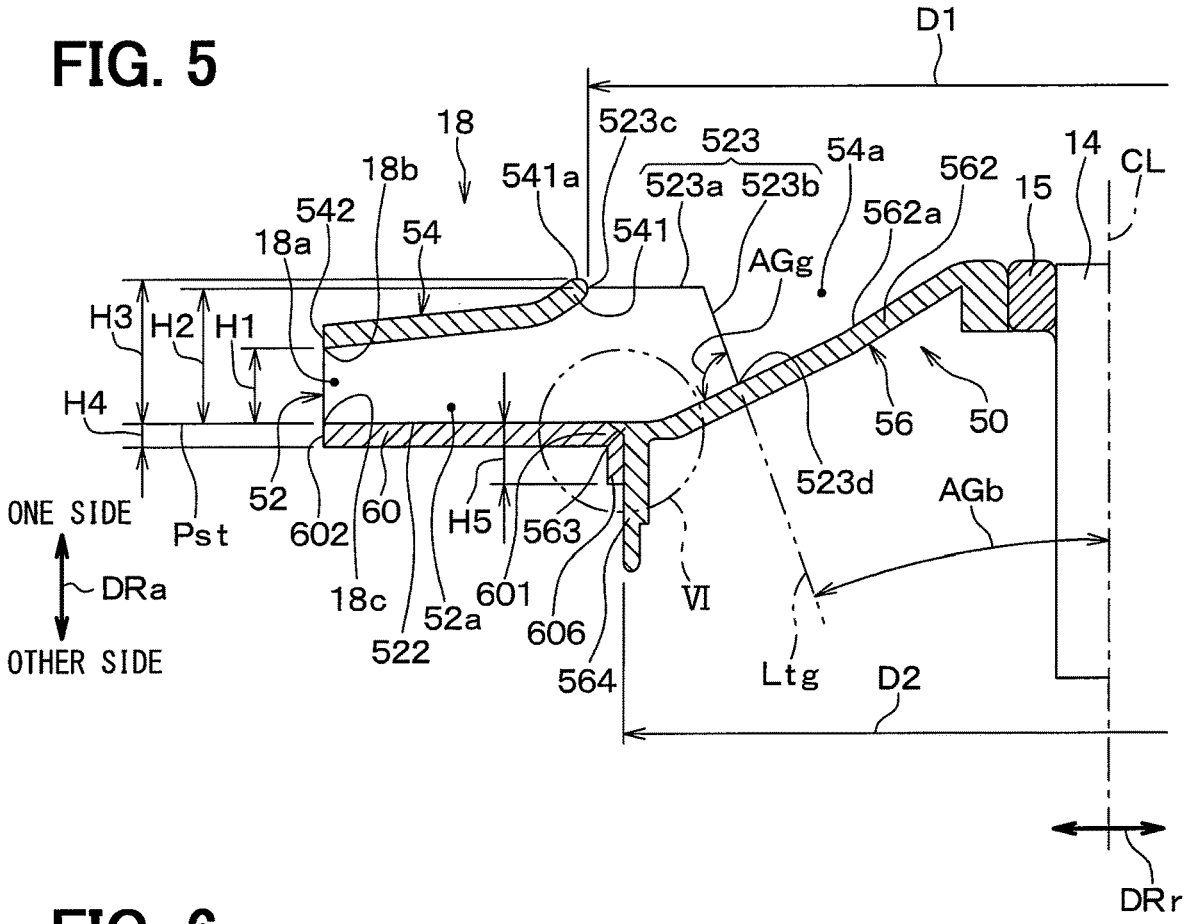
FIG. 5 is a view for describing the detailed shape of the turbofan of the first embodiment, and is a view in which the turbofan, the rotating shaft, and the rotating shaft housing are extracted from the cross-sectional view illustrating a left half of FIG. 2.

Further, as illustrated in FIGS. 2 and 5, each of the multiple blades 52 has a blade front edge 523. The blade front edge 523 of the blade 52 is an end edge formed on the upstream side in an air flow direction of the air that passes through the air intake hole 54*a* and flows to the inter-blade flow path 52*a* between the blades 52, that is, in the air flow direction of the air that flows along the arrows FLa and FLb. The blade front edge 523 inwardly protrudes with respect to the ring inner circumferential end portion 541 in the fan radial direction DRr. In other words, the blade front edge 523 also protrudes inwardly in the fan radial direction DRr with respect to the hub outer circumferential end portion 563.

Specifically, the blade front edge 523 includes two front edges 523*a* and 523*b*, that is, a first front edge 523*a* and a second front edge 523*b*. The first front edge 523*a* and the second front edge 523*b* are each provided to linearly extend, and the first front edge 523*a* and the second front edge 523*b* are coupled in series.

In addition, the first front edge 523*a* is connected to the ring inner circumferential end portion 541 of the shroud ring 54. In other words, the first front edge 523*a* has a ring side connection end 523*c* connected to the shroud ring. Meanwhile, the second front edge 523*b* is connected to the hub guide surface 562*a* of the fan hub portion 56. In other words, the second front edge 523*b* has a hub side connection end 523*d* connected to the fan hub portion 56.

Figure 6:
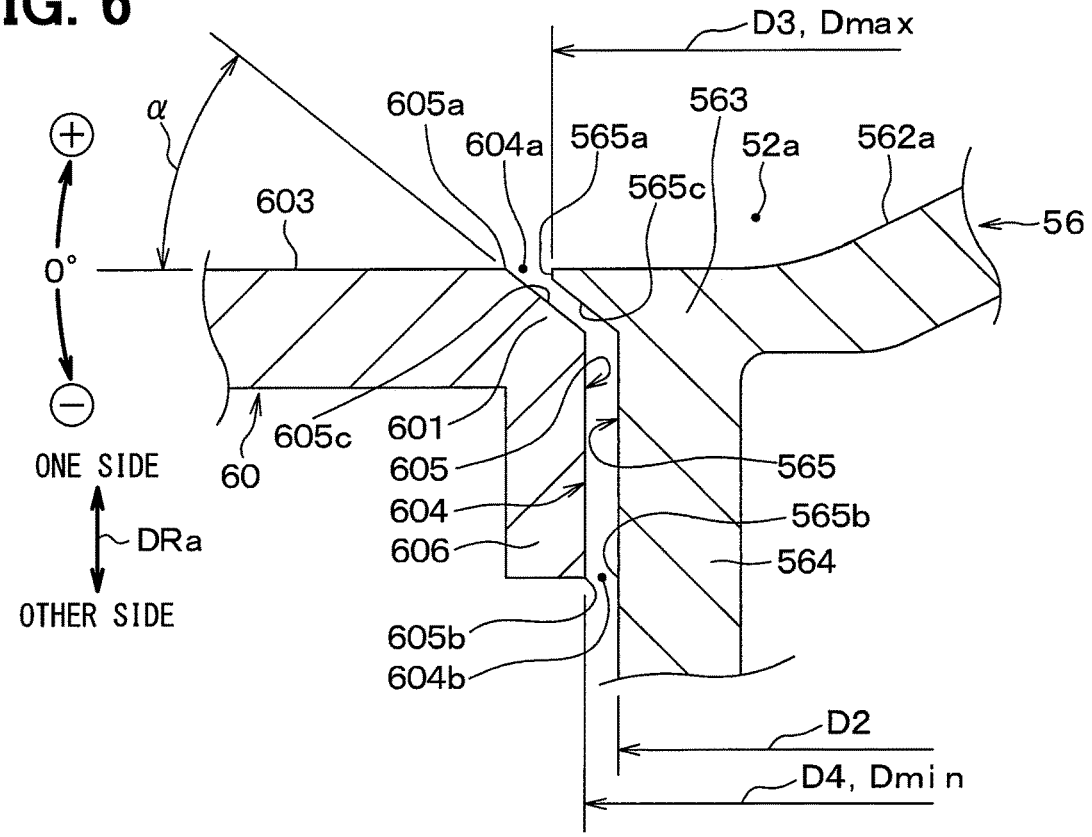
FIG. 6 is an enlarged detailed view of a portion VI in FIG. 5.

The other end side plate 60 illustrated in FIG. 5 is joined to the other side blade tip end 522 of the blade 52 by welding, for example, as described above. Meanwhile, although the other end side plate 60 is fitted to the outer side of the fan hub portion 56 in the fan radial direction DRr, it is not directly joined to the fan hub portion 56. Therefore, as illustrated in FIG. 6 which is an enlarged view of the portion VI in FIG. 5, the other end side plate 60 creates a fitting gap 604 having a minute width between the other end side plate 60 and the fan hub portion 56 in the fan radial direction DRr. In other words, the other end side plate 60 has a side plate fitting surface 605 which faces the fitting gap 604. In addition, the fan hub portion 56 has a hub fitting surface 565 which faces the fitting gap 604.

The hub fitting surface 565 is a surface that faces the side plate fitting surface 605 with the fitting gap 604 interposed therebetween. Therefore, the hub fitting surface 565 is provided so as to extend from the hub outer circumferential end portion 563 to a part of the annular extension portion 564 on the hub outer circumferential end portion 563 side in the fan axial center direction DRa.

In addition, the other end side plate 60 has an inner circumferential end protrusion portion 606 which protrudes to the other side in the fan axial center direction DRa at the side plate inner circumferential end portion 601. The inner circumferential end protrusion portion 606 is provided in a tubular shape over the entire circumference around the fan axial center CL illustrated in FIG. 5. In addition, as illustrated in FIG. 6, the inner circumferential end protrusion portion 606 faces the fitting gap 604 on the inside of the inner circumferential end protrusion portion 606 in the fan radial direction DRr. Accordingly, the side plate fitting surface 605 of the other end side plate 60 is provided so as to extend from the side plate inner circumferential end portion 601 to the inner circumferential end protrusion portion 606 in the fan axial center direction DRa.

Specifically, the fitting gap 604 is a gap which communicates the space on the other side with respect to the other end side plate 60 and the inter-blade flow path 52*a* in the fan axial center direction DRa. Therefore, the fitting gap 604 has a gap one end 604*a* positioned on one side in the fan axial center direction DRa of the fitting gap 604 and a gap other end 604*b* positioned on the other side in the fan axial center direction DRa. In addition, the hub fitting surface 565 of the fan hub portion 56 has a hub side one end forming portion 565*a* that forms the gap one end 604*a* and a hub side other end forming portion 565*b* that forms the gap other end 604*b*. Similarly, the side plate fitting surface 605 has a side plate side one end forming portion 605*a* that forms the gap one end 604*a* and a side plate side other end forming portion 605*b* that forms the gap other end 604*b*.

The hub side one end forming portion 565*a* is positioned at one end of the hub fitting surface 565 in the fan axial center direction DRa, and the hub side other end forming portion 565*b* is positioned at an other end of the hub fitting surface 565 in the fan axial center direction DRa. Similarly, the side plate side one end forming portion 605*a* is positioned at one end of the side plate fitting surface 605 in the fan axial center direction DRa, and the side plate side other end forming portion 605*b* is positioned at an other end of the side plate fitting surface 605 in the fan axial center direction DRa.

Further, as illustrated in FIG. 6, the hub fitting surface 565 has a hub inclined surface 565*c* on one side of the hub fitting surface 565 in the fan axial center direction DRa. The hub inclined surface 565*c* is a tapered surface which is inclined with respect to the fan axial center CL and is formed to have a diameter which increases as approaching one side in the fan axial center direction DRa. In addition, the hub inclined surface 565*c* extends from the hub side one end forming portion 565*a* to the other side in the fan axial center direction DRa.

In addition, the side plate fitting surface 605 has a side plate inclined surface 605*c* which faces the hub inclined surface 565*c* across the fitting gap 604. The side plate inclined surface 605*c* is a tapered surface which is inclined with respect to the fan axial center CL and is formed with a diameter which increases as approaching one side in the fan axial center direction DRa. In addition, the side plate inclined surface 605*c* extends from the side plate side one end forming portion 605*a* to the other side in the fan axial center direction DRa. In addition, when an angle provided by the hub inclined surface 565*c* and the side plate inclined surface 605*c* with respect to the plane orthogonal to the fan axial center CL is defined as $\alpha$, and an angle provided by the taper of which the diameter increases as approaching one side in the fan axial center direction DRa is defined as an angle in a positive direction, the angle $\alpha$ is in a range of "$0° < \alpha < 90°$". Further, the hub inclined surface 565*c* and the side plate inclined surface 605*c* are not required to have the same taper angle with each other.

Here, the detailed shape of the turbofan 18 will be described. As illustrated in FIGS. 5 and 6, since the hub fitting surface 565 includes the hub inclined surface 565*c*, an outer diameter D3 of the hub side one end forming portion 565*a* centered on the fan axial center CL is smaller than an outer diameter D2 of the hub side other end forming portion 565*b*. Therefore, the outer diameter D3 of the hub side one end forming portion 565*a* is a maximum outer diameter Dmax of the fan hub portion 56. In the fan main body member 50, the maximum outer diameter Dmax of the fan hub portion 56 is smaller than a minimum inner diameter D1 of the shroud ring 54. In other words, the entire fan hub portion 56 is disposed further on the inside than the ring inner circumferential end portion 541 in the fan radial direction DRr.

Further, the minimum inner diameter D1 of the shroud ring 54 is the inner diameter of the ring inner circumferential end portion 541, that is, the outer diameter of the intake hole 54*a*. In addition, in the present embodiment, the outer diameter of the annular extension portion 564 matches the outer diameter D2 of the hub side other end forming portion 565*b*. In molding the fan main body member 50, the outer diameter of the annular extension portion 564 is preferably equal to or smaller than the outer diameter D2 of the hub side other end forming portion 565*b*.

Regarding the side plate fitting surface 605, since the side plate fitting surface 605 includes the side plate inclined surface 605*c*, the side plate fitting surface 605 is formed such that the inner diameter of the side plate fitting surface 605 is smallest at a position on the other side in the fan axial center direction DRa as compared with the inner diameter of the hub side one end forming portion 565*a*. In other words, an inner diameter D4 of the side plate side other end forming portion 605*b* is a minimum inner diameter Dmin of the side plate fitting surface 605, that is, the minimum inner diameter Dmin of the other end side plate 60. In addition, the minimum inner diameter Dmin of the side plate fitting surface 605 is smaller than the outer diameter D3 of the hub side one end forming portion 565*a*. From the viewpoint of a radial dimension of the turbofan 18 as described above, the relationship of "D1>D3>D4>D2" is established.

Figure 7:
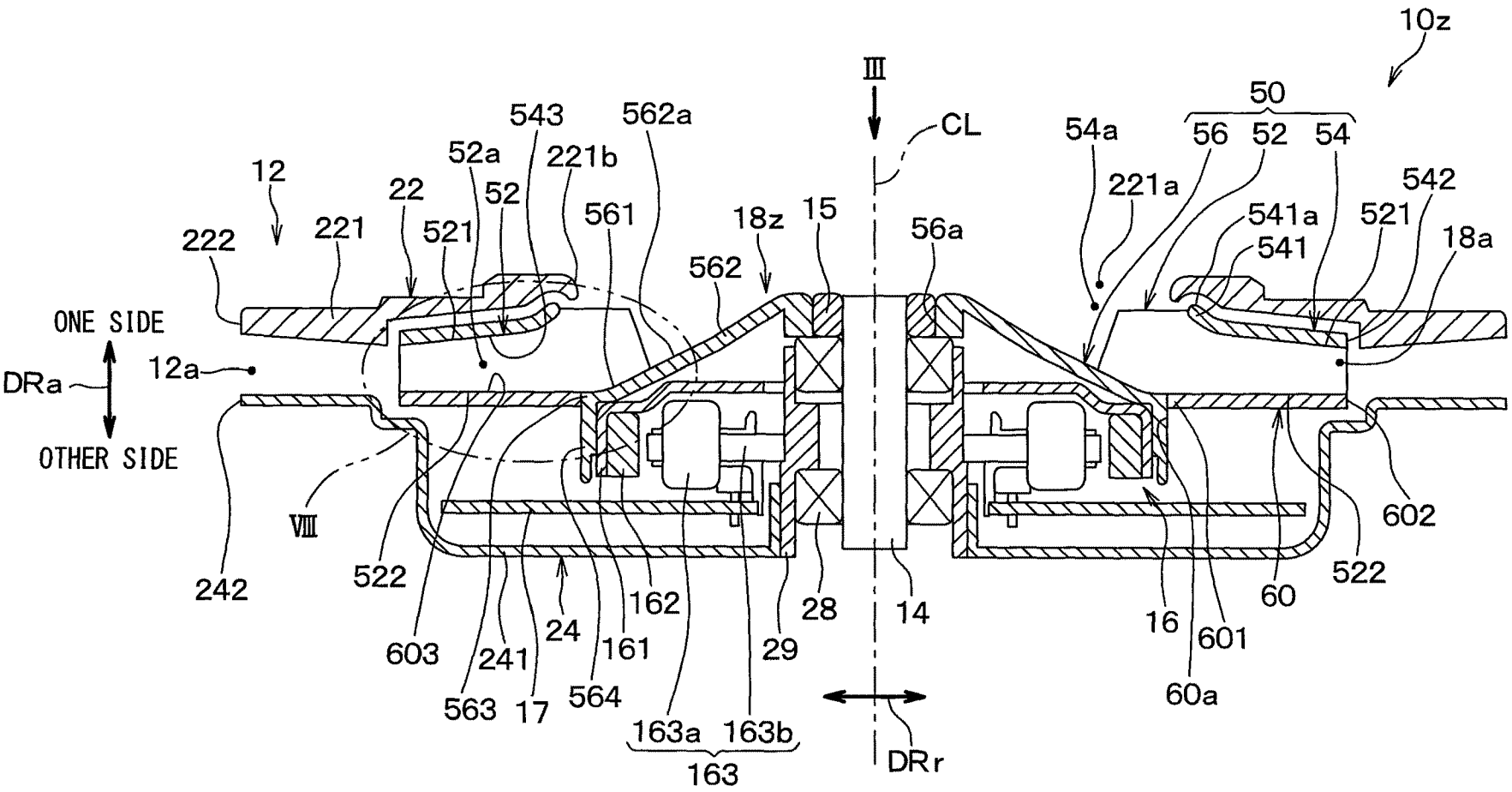
FIG. 7 is a view illustrating a comparative example to be compared with the first embodiment, and is a cross-sectional view that corresponds to FIG. 2 of the first embodiment.
Figure 8:
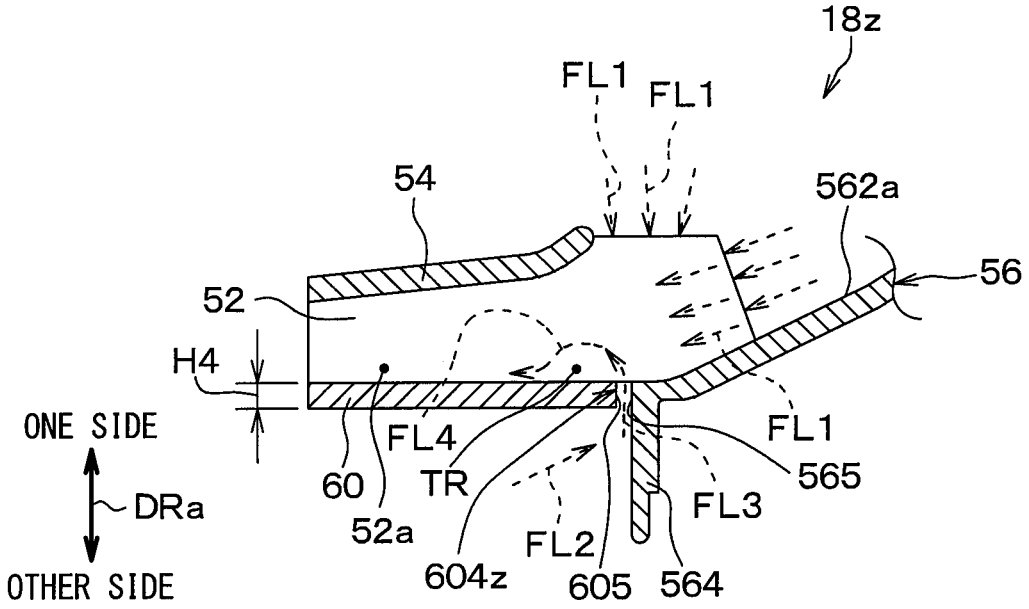
FIG. 8 is an enlarged detailed view of a portion VIII in FIG. 7 in the above-described comparative example, and is a view in which the fan main body member and an other end side plate are extracted.

In order to describe the meaning of forming the hub fitting surface 565 and the side plate fitting surface 605 in this manner, a virtual blower 10*z* illustrated in FIGS. 7 and 8 is assumed as a comparative example. In other words, in a turbofan 18*z* of the blower 10*z* of the comparative example, as illustrated in FIGS. 7 and 8, a reference gap 604*z* that corresponds to the fitting gap 604 of the present embodiment is provided. The reference gap 604*z* is defined on the assumption that the hub inclined surface 565*c*, the side plate inclined surface 605*c*, and the inner circumferential end protrusion portion 606 are not provided for the turbofan 18 of the present embodiment, and the hub fitting surface 565 and the side plate fitting surface 605 are constant circular cross-section at any location in the fan axial center direction DRa. In addition, the blower 10*z* of the comparative example has the same configuration as the blower 10 of the present embodiment except for the reference gap 604*z*.

Specifically, in the turbofan 18*z* of the comparative example, the length of the reference gap 604*z* in the fan axial center direction DRa is defined as an axial thickness H4 of the other end side plate 60. The axial thickness H4 is a thickness of the other end side plate 60 in the fan axial center direction DRa, and is a general thickness obtained as an average value when a local shape which is locally provided on the other end side plate 60 (for example, the inner circumferential end protrusion portion 606 of the present embodiment) is removed from the other end side plate 60.

In addition, a passage cross-sectional area of the reference gap 604*z* that serves as a passage through which the air passes is constant at any location in the fan axial center direction DRa, and the minimum passage cross-sectional area of the fitting gap 604 in the fan axial center direction DRa is the same area. The minimum passage cross-sectional area in the direction of the fan axial center direction DRa is the minimum value of the cross-sectional area obtained by cutting the fitting gap 604 of the present embodiment along an axis orthogonal cross-section orthogonal to the fan axial center CL. In other words, the minimum passage cross-sectional area in the fan axial center direction DRa corresponds to a fitting play in the fan radial direction DRr generated between the fan hub portion 56 and the other end side plate 60.

In addition, the cross-sectional shape of the reference gap 604*z* in the axis orthogonal cross-section is made uniform at any location in the fan axial center direction DRa.

Since the reference gap 604*z* is formed in the turbofan 18*z*, when the turbofan 18*z* rotates and the air flows to the inter-blade flow path 52*a* between the blades 52 as illustrated by the arrow FL1, the air blown out from the turbofan 18*z* passes through the reference gap 604*z* as indicated by arrows FL2, FL3, and FL4, and a backflow phenomenon is exhibited in which the blown air flows into the inter-blade flow path 52*a* between the blades 52 through the reference gap 604*z*.

The backflow phenomenon can be also be exhibited in the present embodiment. However, the outflow velocity when the side plate external air on the side opposite to the inter-blade flow path 52*a* side with respect to the other end side plate 60 passes through the fitting gap 604 of the present embodiment and flows out to the inter-blade flow path 52*a*, is reduced as compared with a case where the air passes through the reference gap 604*z* of the comparative example and flows out to the inter-blade flow path 52*a*. The fitting gap 604 of the present embodiment is provided in this manner as compared with the reference gap 604*z* of the comparative example.

This is because the turbofan 18 of the present embodiment is provided with the hub inclined surface 565*c*, the side plate inclined surface 605*c*, and the inner circumferential end protrusion portion 606 as illustrated in FIG. 6. Accordingly, this is because the passage length when the side plate external air passes through the fitting gap 604 is longer than the passage length when the side plate external air passes through the reference gap 604*z*. In other words, a case where the fitting gap 604 is provided so as to reduce the above-described outflow velocity means that the fitting gap 604 is formed such that the passage length when the side plate external air passes through the fitting gap 604 is longer than the passage length when the side plate external air passes through the reference gap 604*z*. In short, in the fitting gap 604 of the present embodiment, the pressure loss against the air flow is larger than that of the reference gap 604*z* of the comparative example due to the long passage length, so that the outflow velocity is reduced by the amount.

In addition, as illustrated in FIG. 5, since the other end side plate 60 of the present embodiment has the inner circumferential end protrusion portion 606, a thickness H5 of the fitting gap 604 in the fan axial center direction DRa is larger than the axial width H4 of the other end side plate 60 in the fan axial center direction. In addition, reducing the outflow velocity also includes reducing the outflow velocity to zero. Further, the passage length of the fitting gap 604 is, that is, a flowing length by which the air that passes through the fitting gap 604 reaches the gap one end 604*a* from the gap other end 604*b*, and is also similar to the passage length of the reference gap 604*z* in the comparative example.

Next, regarding the axial dimension of the turbofan 18 of the present embodiment, as illustrated in FIG. 5, in the fan axial center direction Dra, a height H2 from a predetermined reference position Pst to the ring side connection end 523*c* is larger than a height H1 from the reference position Pst to one end 18*b* positioned on one side of the fan axial center direction DRa of the air outlet 18*a*. At the same time, the height H2 to the ring side connection end 523*c* is smaller than a height H3 from the above-described reference position Pst to the end 541*a* on one side of the ring inner circumferential end portion 541 in the fan axial center direction DRa. In short, a relationship of "H1<H2<H3" is established.

In other words, the ring side connection end 523*c* is positioned further on one side in the fan axial center direction DRa than the one end 18*b* of the air outlet 18*a*. In addition, the ring side connection end 523*c* is positioned further on the other side in the fan axial center direction DRa than the end 541*a* on one side of the ring inner circumferential end portion 541 in the fan axial center direction DRa. In addition, in FIG. 5, the above-described reference position Pst is an other end 18*c* positioned on the other side of the fan axial center direction DRa of the air outlet 18*a*, but may be placed in any place.

Next, regarding the blade front edge 523 of the turbofan 18, when assuming a virtual tangent line Ltg which is in contact with the blade front edge 523 at the hub side connection end 523*d* of the blade front edge 523, the virtual tangent line Ltg is inclined with respect to the fan axial center CL such that one side of the virtual tangent line Ltg in the fan axial center direction DRa faces the outer side of the fan radial direction DRr. The blade front edge 523 is configured in this manner. In short, an angle AGb provided by the blade front edge 523 with respect to the fan axial center CL at the hub side connection end 523*d*, that is, an axial center angle AGb in FIG. 5, is "0°<AGb<90°" in a relationship with the fan axial center CL.

In addition, in the relationship between the blade front edge 523 and the hub guide surface 562*a*, an angle AGg provided by the blade front edge 523 with respect to the hub guide surface 562*a* at the hub side connection end 523*d*, that is, a countermeasure inner surface angle AGg of FIG. 5 which is provided on the outer side of the blade front edge 523 in the fan radial direction DRr is preferably equal to or larger than 70°. This is for smooth introduction of the air that flows along the hub guide surface 562*a* into the inter-blade flow path 52*a*. In addition, in the present embodiment, as illustrated in FIG. 5, the countermeasure inner surface angle AGg is 90°.

As illustrated in FIGS. 2 and 3, the turbofan 18 configured in this manner rotates integrally with the motor rotor 161 in the fan rotation direction DRf. Along with this, the blade 52 of the turbofan 18 gives a momentum to the air, and the turbofan 18 blows out the air outward in the radial direction from the air outlet 18*a* open to the outer circumference of the turbofan 18. At this time, the air which is suctioned from the intake hole 54*a* and sent out by the blade 52, that is, the air blown out from the air outlet 18*a* is discharged to the outer side of the blower 10 via the air outlet 12*a* provided by the casing 12.

Figure 9:
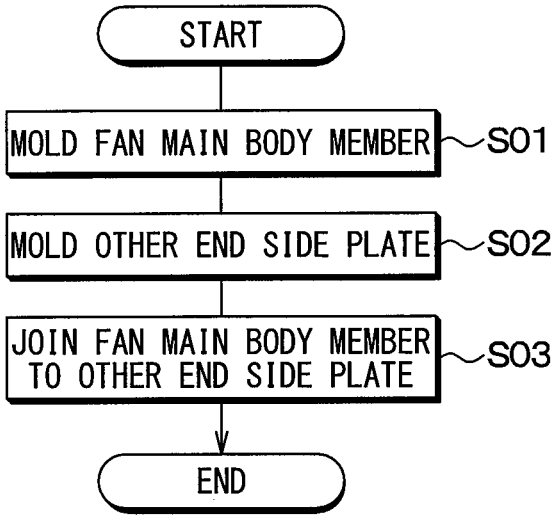
FIG. 9 is a flowchart illustrating a manufacturing process of the turbofan in the first embodiment.

Next, a method of manufacturing the turbofan 18 will be described with reference to the flowchart of FIG. 9. As illustrated in FIG. 9, first, in step S01 as a fan main body member molding step, molding of the fan main body member 50 is performed. In other words, multiple blades 52, the shroud ring 54, and the fan hub portion 56, which are component elements of the fan main body member 50, are integrally molded.

Figure 10:
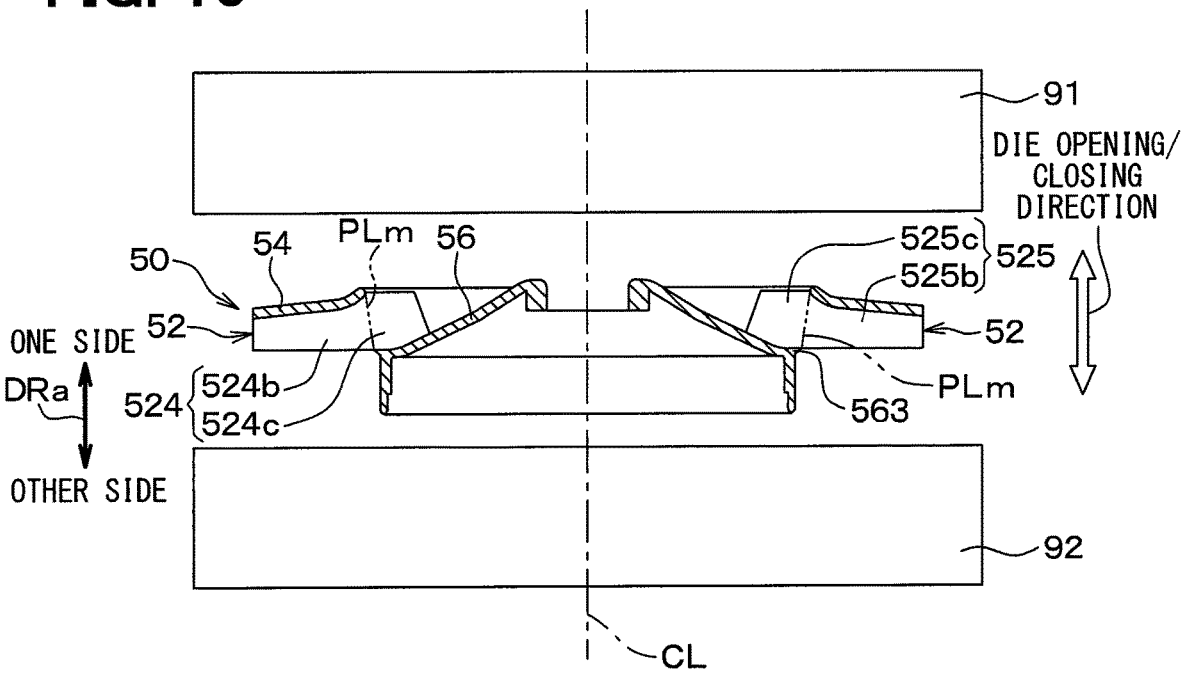
FIG. 10 is a schematic view illustrating a schematic configuration of a molding die for molding a fan main body member in the first embodiment.

Specifically, as illustrated in FIG. 10, the multiple blades 52, the shroud ring 54, and the fan hub portion 56 are integrally molded by the injection molding in which one pair of molding dies 91 and 92 which open and close in the fan axial center direction DRa are used. The one pair of molding dies 91 and 92 include the one side die 91 and an other side die 92. In addition, the other side die 92 is a die provided on an other side of the one side die 91 in the fan axial center direction DRa.

In molding the fan main body member 50, a parting line trace PLm of the molding dies 91 and 92 is linearly provided on the positive pressure surface 524 and the negative pressure surface 525 of the blade 52. In other words, both of a positive pressure surface outer region 524*b* that occupies the outer side of the parting line trace PLm in the fan radial direction DRr of the positive pressure surface 524 and a negative pressure surface outer region 525*b* that occupies the outer side of the parting line trace PLm in the fan radial direction DRr of the negative pressure surface 525, are provided by the other side die 92. In addition, both of a positive pressure surface inner region 524*c* that occupies the inner side of the parting line trace PLm in the fan radial direction DRr of the positive pressure surface 524 and a negative pressure surface inner region 525*c* that occupies the inner side of the parting line trace PLm in the fan radial direction DRr of the negative pressure surface 525, are provided by the one side die 91. The parting line trace PLm is a trace provided by transferring a parting line Lpt between the one side die 91 and the other side die 92 to the surface of the fan main body member 50 in the injection molding. For example, the parting line Lpt is indicated by a two-dot chain line in FIG. 4.

In other words, as illustrated in FIG. 10, the positive pressure surface outer region 524*b* is a region which is provided further on the outside than the hub outer circumferential end portion 563 of the positive pressure surface 524 in the fan radial direction DRr. In addition, the positive pressure surface inner region 524*c* is a region which is provided further on the inside than the positive pressure surface outer region 524*b* of the positive pressure surface 524 in the fan radial direction DRr. Similarly, the negative pressure surface outer region 525*b* is a region which is provided further on the outside than the hub outer circumferential end portion 563 of the negative pressure surface 525 in the fan radial direction DRr. In addition, the negative pressure surface inner region 525*c* is a region which is provided further on the inside than the negative pressure surface outer region 525*b* of the negative pressure surface 525 in the fan radial direction DRr. In addition, the parting line trace PLm on the positive pressure surface 524 and the negative pressure surface 525 is provided so as to linearly extend from the ring inner circumferential end portion 541 to the hub outer circumferential end portion 563 illustrated in FIG. 2.

In the flowchart of FIG. 9, the process proceeds to step S02 after step S01. In step S02 as the other end side plate molding step, the molding of the other end side plate 60 is performed by, for example, injection molding. In addition, any of step S01 and step S02 may be executed first.

The process proceeds to step S03 after step S02. In step S03 as a joining step, the other end side plate 60 illustrated in FIG. 2 is fitted to the outside in the radial direction of the fan hub portion 56. At the same time, the other end side plate 60 is joined to each of the other side blade tip portions 522 of the blade 52. The blade 52 and the other end side plate 60 are joined to each other, for example, by vibration welding or thermal welding. By completing step S03, the turbofan 18 is completed.

As described above, according to the present embodiment, the fitting gap 604 illustrated in FIG. 6 is formed such that the outflow velocity when the side plate external air on the side opposite to the inter-blade flow path 52*a* side with respect to the other end side plate 60 passes through the fitting gap 604 and outflows to the inter-blade flow path 52*a* is reduced as compared with the outflow velocity when the air passes through the reference gap 604*z* and outflows to the inter-blade flow path 52*a* in the comparative example illustrated in FIG. 8. Therefore, a momentum of the air when flowing into the inter-blade flow path 52*a* from the fitting gap 604 is restricted as compared with a momentum when the air flows into the inter-blade flow path 52*a* from the reference gap 604*z*.

Meanwhile, as illustrated in FIG. 8, in the turbofan 18*z* of the comparative example, the momentum of the air is not restricted that much and the backflow air from the reference gap 604*z* merges the inter-blade flow path 52*a* to a main flowing air that flows as indicated by the arrow FL1, as indicated by arrows FL2, FL3, and FL4. Therefore, in the comparative example, the air flow is likely to be separated from a TR portion on the other end side plate 60. In addition, the backflow air is air that flows into the inter-blade flow path 52*a* through the fitting gap 604 or the reference gap 604*z* of the side plate external air.

Therefore, in the present embodiment, the air flow can be prevented from being separated from the other end side plate 60 due to an air inflow from the fitting gap 604 illustrated in FIG. 6 into the inter-blade flow path 52*a*. As a result, the fan performance, such as an increase in air volume of the turbofan 18 and noise reduction, can be improved.

In addition, according to the present embodiment, as illustrated in FIGS. 6 and 8, a case where the fitting gap 604 is provided so as to reduce the above-described outflow velocity means that the fitting gap 604 is formed such that the passage length when the backflow air passes through the fitting gap 604 is longer than the passage length when the backflow air passes through the reference gap 604*z*. Therefore, by increasing the pressure loss when the backflow air passes through the fitting gap 604, the flow rate of the backflow air can be reduced. At the same time, the air flow from the other end side plate 60 due to the air inflow can be prevented from the fitting gap 604 to the inter-blade flow path 52*a* from being separated. As a result, the air volume of the turbofan 18 can increase and noise can be reduced.

Further, according to the present embodiment, as illustrated in FIG. 6, the hub side one end forming portion 565*a* is formed such that the outer diameter D3 of the hub side one end forming portion 565*a* is larger than the outer diameter D2 of the hub side other end forming portion 565*b*. Therefore, as compared with a case where the fitting gap 604 simply extends in the fan axial center direction DRa similar to the reference gap 604*z* of the comparative example, it is easy to ensure a long passage length of the fitting gap 604 that serves as an air passage. Accordingly, the pressure loss when the backflow air passes through the fitting gap 604 can increase.

In addition, according to the present embodiment, the minimum inner diameter Dmin of the side plate fitting surface 605 is smaller than the outer diameter D3 of the hub side one end forming portion 565*a*. Therefore, the passage width of the fitting gap 604 can be narrowed while ensuring a long passage length of the fitting gap 604. Accordingly, the pressure loss when the backflow air passes through the fitting gap 604 can increase.

Figure 11:
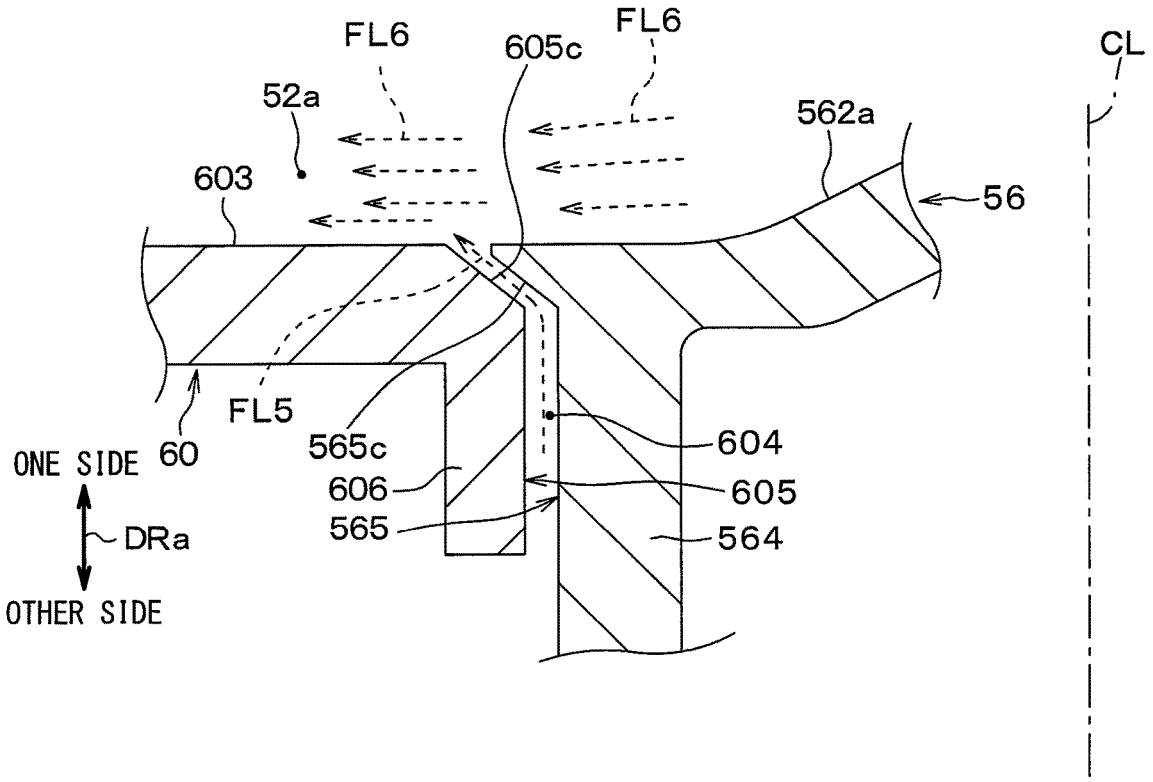
FIG. 11 is a view in which an air flow is additionally written as a broken line arrow in FIG. 6 in the first embodiment.

Further, according to the present embodiment, as illustrated in FIGS. 6 and 11, the hub inclined surface 565*c* included in the hub fitting surface 565 is formed with a diameter that increases as approaching one side in the fan axial center direction DRa. Therefore, the direction of the backflow air flow when flowing from the fitting gap 604 to the inter-blade flow path 52*a* as indicated by the arrow FL5 can be made easy to follow the air flow directed radially outward as illustrated by the arrow FL6 in the inter-blade flow path 52*a*. According to this, it is possible to obtain an effect of preventing the air flow from being separated from the other end side plate 60. Therefore, the air volume of the turbofan 18 can increase and noise can be reduced.

In addition, according to the present embodiment, similar to FIG. 5, the width H5 of the fitting gap 604 in the fan axial center direction DRa is larger than the axial thickness H4 of the other end side plate 60 in the fan axial center direction DRa. Therefore, a long passage length of the fitting gap 604 can be ensured, and the pressure loss when the backflow air passes through the fitting gap 604 can increase. As a result, the flow rate of the backflow air that passes through the fitting gap 604 can be reduced, the air volume of the turbofan 18 can increase, and noise can be reduced.

In addition, according to the present embodiment, similar to FIG. 6, the inner circumferential end protrusion portion 606 of the other end side plate 60 is provided in a tubular shape over the entire circumference around the fan axial center CL. Therefore, as compared with a case where the inner circumferential end protrusion portion 606 does not extend over the entire circumference, the pressure loss when the backflow air passes through the fitting gap 604 can increase. In other words, the action of reducing the flow rate of the backflow air which passes through the fitting gap 604 can increase.

Further, according to the present embodiment, as illustrated in FIGS. 5 and 6, the maximum outer diameter Dmax of the fan hub portion 56 is smaller than the minimum inner diameter D1 of the shroud ring 54. Therefore, as illustrated in FIG. 10, the multiple blades 52, the shroud ring 54, and the fan hub portion 56 can be easily integrally molded with the fan axial center direction DRa as an opening and closing direction of the molding dies 91 and 92.

Second Embodiment

Next, a second embodiment will be described. In the present embodiment, points different from the above-described first embodiment will mainly be described. In addition, the same or equivalent parts as those in the above-described embodiment will be omitted or simplified. This also applies to a third and subsequent embodiments which will be described later.

Even in the present embodiment, similar to the first embodiment, the outflow velocity when the side plate external air passes through the fitting gap 604 of the present embodiment and flows out to the inter-blade flow path 52*a*, is reduced as compared with a case where the air passes through the reference gap 604*z* of the comparative example illustrated in FIGS. 7 and 8 and flows out to the inter-blade flow path 52*a*. However, in the present embodiment, the shape of the fitting gap 604 is different from that of the first embodiment.

Figure 12:
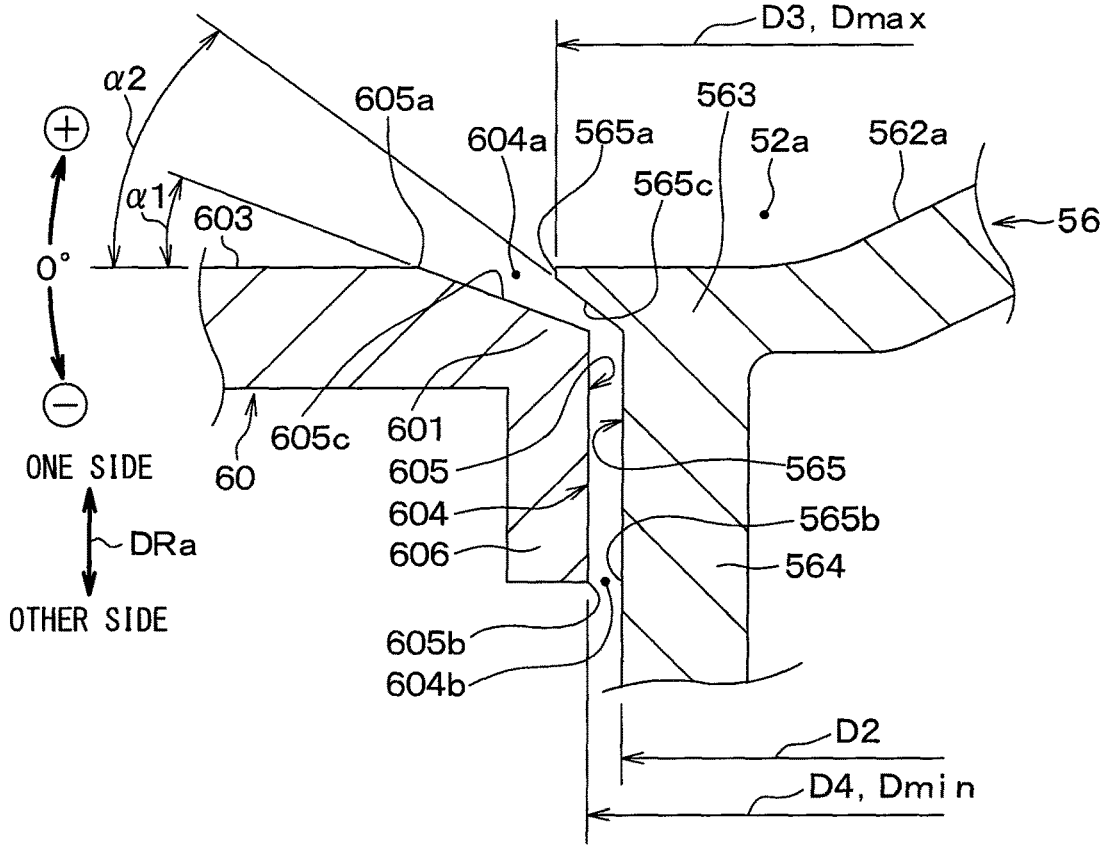
FIG. 12 is an enlarged detailed view of the portion VI of FIG. 5 in a second embodiment, and is a cross-sectional view that corresponds to FIG. 6 of the first embodiment.

Specifically, as illustrated in FIG. 12, an angle $\alpha$1 provided by the side plate inclined surface 605*c* with respect to a plane orthogonal to the fan axial center CL is smaller than an angle α2 provided by the hub inclined surface 565*c* with respect to the plane. Therefore, the spacing between the hub inclined surface 565*c* and the side plate inclined surface 605*c* is widened toward one side in the fan axial center direction DRa. In other words, the side plate inclined surface 605*c* is formed such that a radial direction spacing which is formed in the fan radial direction DRr between the side plate inclined surface 605*c* and the hub inclined surface 565*c* increases as approaching one side of the fan axial center direction DRa.

Since the hub inclined surface 565*c* and the side plate inclined surface 605*c* are provided as described above, in the present embodiment, similar to the first embodiment, the passage length when the backflow air passes through the fitting gap 604 is longer than the passage length when the backflow air passes through the reference gap 604*z* of the comparative example. In addition to this, in the present embodiment, unlike the first embodiment, the passage cross-sectional area of the fitting gap 604 that serves as a passage through which the backflow air passes increases as approaching the inter-blade flow path 52*a*. A case where the fitting gap 604 is provided so as to reduce the above-described outflow velocity means that the fitting gap 604 is provided in this manner.

Therefore, according to the present embodiment, by increasing the passage length of the fitting gap 604, the pressure loss when the backflow air passes through the fitting gap 604 can increase, and accordingly reducing the flow rate of the backflow air. In addition to this, by enlarging the passage cross-sectional area on the inter-blade flow path 52*a* side in the fitting gap 604, the outflow velocity when the backflow air flows out to the inter-blade flow path 52*a* can be reduced. Accordingly, the backflow air from the fitting gap 604 is likely to be merged with the air that flows through the inter-blade flow path 52*a*. In addition, the passage cross-sectional area of the fitting gap 604 is a cross-sectional area of the fitting gap 604 in a cross-section orthogonal to the main flow direction of the backflow air that flows through the fitting gap 604.

In addition, according to the present embodiment, the side plate inclined surface 605*c* is formed which a diameter that increases in the fan axial center direction DRa as approaching the one side and the spacing between the side plate inclined surface 605*c* and the hub inclined surface 565*c* in the fan radial direction DRr increases as approaching the one side of the fan axial center direction DRa. Therefore, the passage length of the fitting gap 604 can be made longer than the reference gap 604*z* of the comparative example, and the passage cross-sectional area of the fitting gap 604 can be enlarged at the inter-blade flow path 52*a* side. Accordingly, it is necessary to realize the reduction of the flow rate of the backflow air due to an increase in pressure loss of the fitting gap 604 and the reduction of the outflow velocity of the backflow air due to the increase in passage cross-sectional area on the inter-blade flow path 52*a* side in the fitting gap 604.

In addition, in the present embodiment, effects similar to those of the first embodiment can be obtained from the configuration common to the above-described first embodiment.

Third Embodiment

Next, a third embodiment will be described. In the present embodiment, points different from the above-described first embodiment will mainly be described.

Even in the present embodiment, similar to the first embodiment, the outflow velocity when the side plate external air passes through the fitting gap 604 of the present embodiment and flows out to the inter-blade flow path 52*a*, is reduced as compared with a case where the air passes through the reference gap 604*z* of the comparative example illustrated in FIGS. 7 and 8 and flows out to the inter-blade flow path 52*a*. However, in the present embodiment, the shape of the fitting gap 604 is different from that of the first embodiment.

Figure 13:
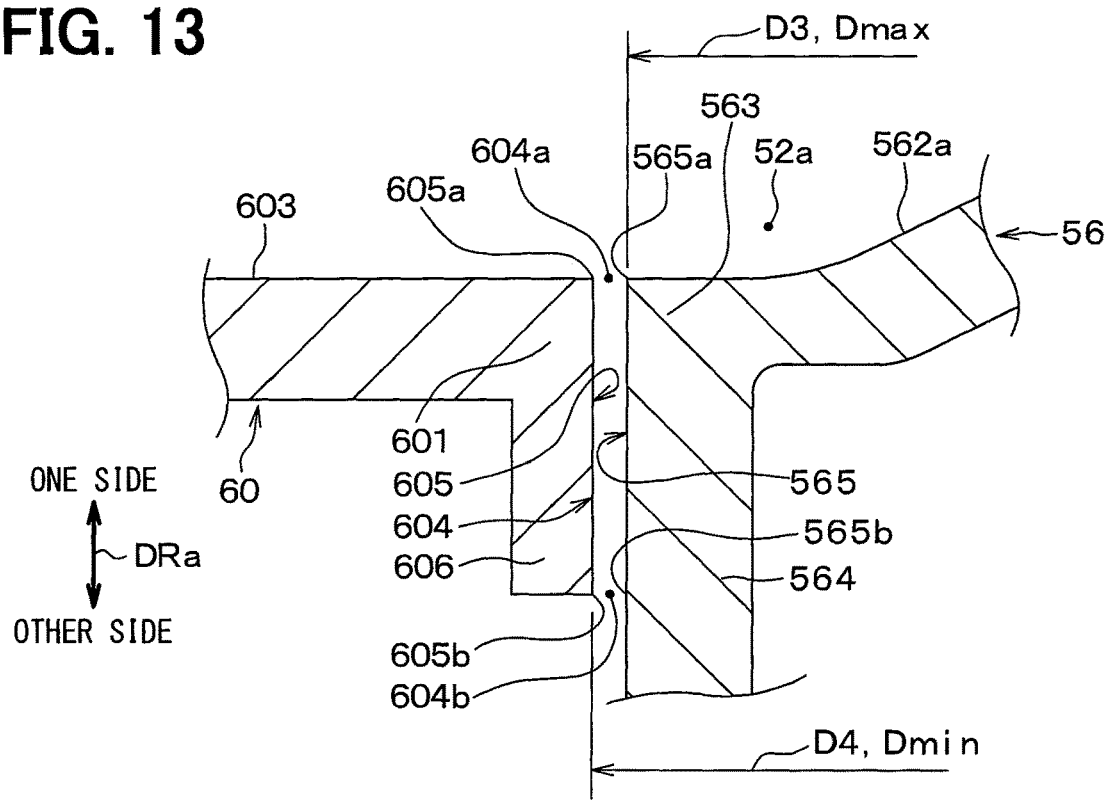
FIG. 13 is an enlarged detailed view of the portion VI of FIG. 5 in a third embodiment, and is a cross-sectional view that corresponds to FIG. 6 of the first embodiment.

Specifically, as illustrated in FIG. 13, the hub inclined surface 565*c* and the side plate inclined surface 605*c* are not provided. Therefore, the diameter of the hub fitting surface 565 does not change at any location in the fan axial center direction DRa. In addition, the diameter of the side plate fitting surface 605 does not change at any location in the fan axial center direction DRa, either. In other words, the outer diameter D2 of the hub side other end forming portion 565*b* illustrated in FIG. 6 is the same as the outer diameter D3 of the hub side one end forming portion 565*a*.

However, while not as much as in the first embodiment, even in the present embodiment, as illustrated in FIG. 13, the passage length when the backflow air passes through the fitting gap 604 is longer than the passage length when the backflow air passes through the reference gap 604*z* of the comparative example. This is because, also in the present embodiment, similar to the first embodiment, the other end side plate 60 has the inner circumferential end protrusion portion 606.

As described above, according to the present embodiment, since the hub fitting surface 565 does not have the hub inclined surface 565*c*, the maximum outer diameter Dmax of the fan hub portion 56 can be reduced. Therefore, under the condition that the maximum outer diameter Dmax of the fan hub portion 56 is made smaller than the minimum inner diameter D1 of the shroud ring 54, the maximum outer diameter Dmax of the fan hub portion 56 can be allowed to have a margin.

In the present embodiment, effects similar to those of the first embodiment can be obtained from the configuration common to the above-described first embodiment.

Fourth Embodiment

Next, the fourth embodiment will be described. In the present embodiment, points different from the above-described first embodiment will mainly be described.

Even in the present embodiment, similar to the first embodiment, the outflow velocity when the side plate external air passes through the fitting gap 604 of the present embodiment and flows out to the inter-blade flow path 52*a*, is reduced as compared with a case where the air passes through the reference gap 604*z* of the comparative example illustrated in FIGS. 7 and 8 and flows out to the inter-blade flow path 52*a*. However, in the present embodiment, the shape of the fitting gap 604 is different from that of the first embodiment.

Figure 14:
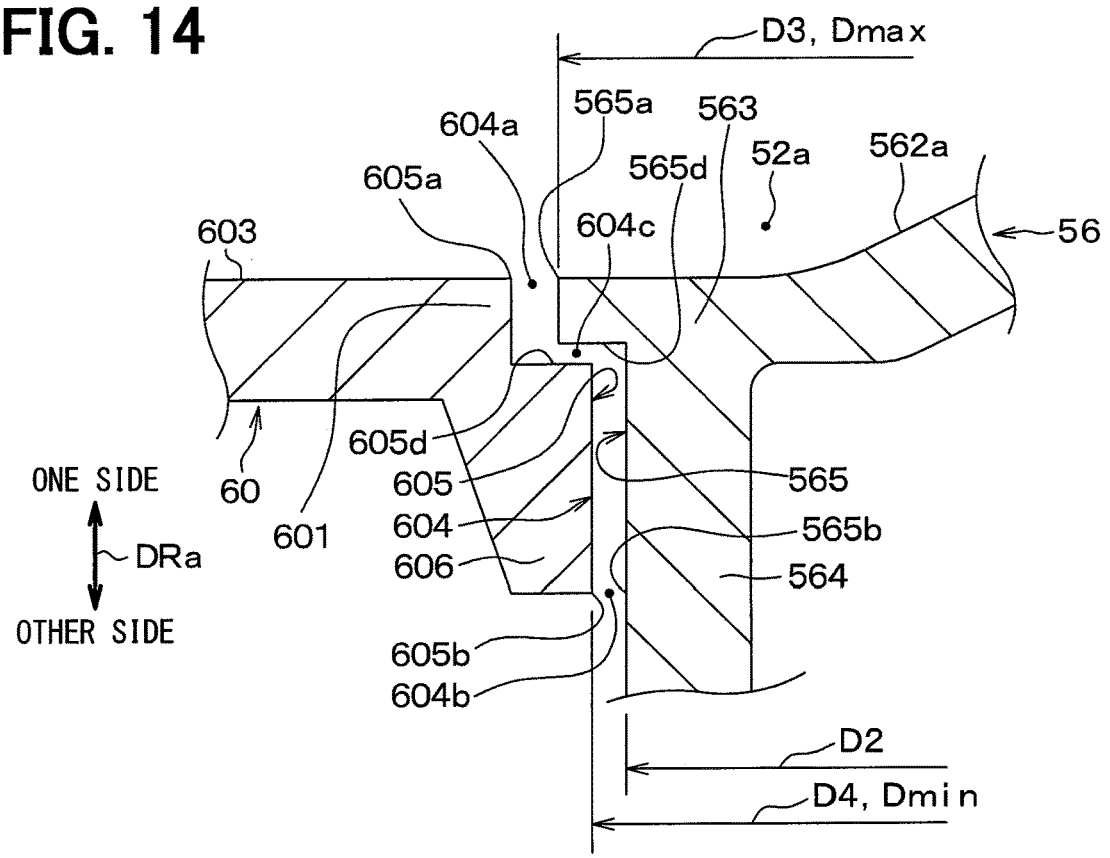
FIG. 14 is an enlarged detailed view of the portion VI of FIG. 5 in a fourth embodiment, and is a cross-sectional view that corresponds to FIG. 6 of the first embodiment.

Specifically, as illustrated in FIG. 14, the fitting gap 604 has an intermediate gap 604*c* as a part of the fitting gap 604. The intermediate gap 604*c* is disposed in an intermediate portion of the fitting gap 604 in the fan axial center direction DRa. In addition, the intermediate gap 604*c* is a gap that expands in a planar shape along the fan radial direction DRr.

Further, the hub fitting surface 565 includes a hub intermediate surface 565*d* that faces the intermediate gap 604*c*, and the side plate fitting surface 605 includes a side plate intermediate surface 605*d* that faces the intermediate gap

604*c* and faces the hub intermediate surface 565*d*. The hub intermediate surface 565*d* and the side plate intermediate surface 605*d* are provided by planes orthogonal to the fan axial center CL.

Therefore, the backflow air that flows through the intermediate gap 604*c* flows toward the outside in the fan radial direction DRr. Therefore, the cross-sectional shape of the fitting gap 604 in the axial cross-section including the fan axial center CL has a crank shape. In addition, in the present embodiment, unlike the first embodiment, the hub inclined surface 565*c* and the side plate inclined surface 605*c* are not provided.

As described above, according to the present embodiment, the fitting gap 604 is formed such that the cross-sectional shape of the fitting gap 604 in the axial cross-section has a crank shape. Therefore, the fitting gap 604 can be provided with a labyrinth-esque structure. In addition, according to the present embodiment, the pressure loss when the backflow air passes through the fitting gap 604 by the labyrinth-esque structure can increase, and accordingly reducing the flow rate of the backflow air.

In addition, in the present embodiment, effects similar to those of the first embodiment can be obtained from the configuration common to the above-described first embodiment.

Fifth Embodiment

Next, a fifth embodiment will be described. In the present embodiment, points different from the above-described fourth embodiment will mainly be described.

Even in the present embodiment, similar to the fourth embodiment, the outflow velocity when the side plate external air passes through the fitting gap 604 of the present embodiment and flows out to the inter-blade flow path 52*a*, is reduced as compared with a case where the air passes through the reference gap 604*z* of the comparative example illustrated in FIGS. 7 and 8 and flows out to the inter-blade flow path 52*a*. However, in the present embodiment, the shape of the fitting gap 604 is different from that of the fourth embodiment.

Figure 15:
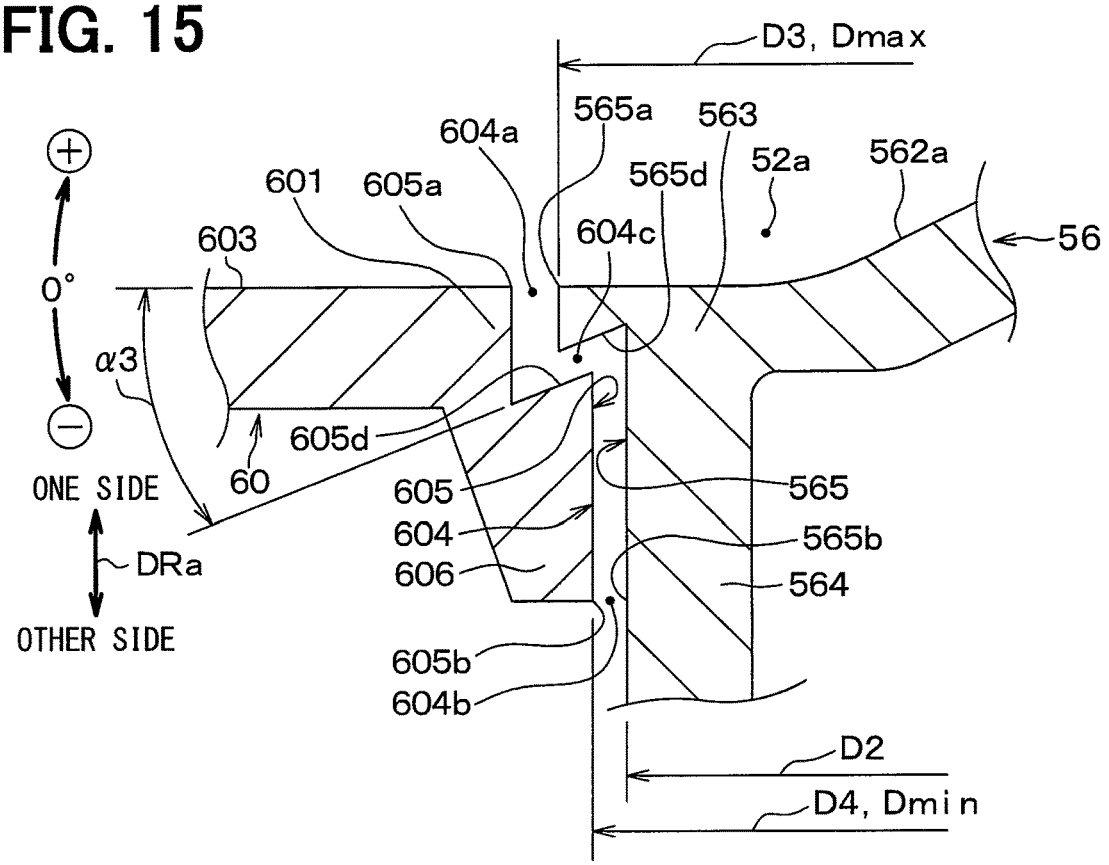
FIG. 15 is an enlarged detailed view of the portion VI of FIG. 5 in a fifth embodiment, and is a cross-sectional view that corresponds to FIG. 14 of the fourth embodiment.
Figure 16:
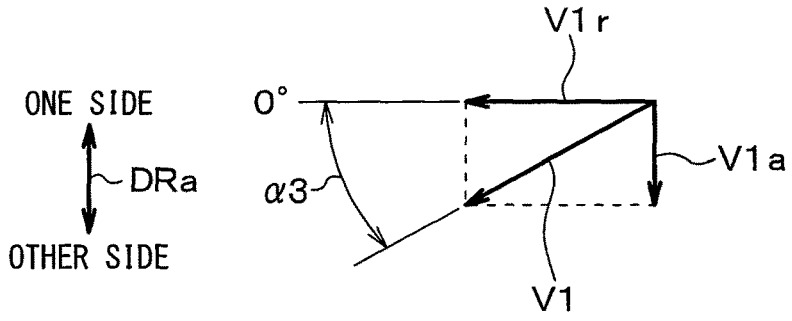
FIG. 16 is a view illustrating a velocity component included in the flow velocity of air that flows through the intermediate gap of FIG. 15 in the fifth embodiment.

Specifically, as illustrated in FIG. 15, an angle $\alpha$3 provided by the hub intermediate surface 565*d* and the side plate intermediate surface 605*d* with respect to the plane orthogonal to the fan axial center CL is a negative value. In other words, the angle $\alpha$3 is in a range of "$-90° < \alpha < 0°$". Therefore, in the intermediate gap 604*c* provided by the hub intermediate surface 565*d* and the side plate intermediate surface 605*d*, as illustrated in FIG. 16, the backflow air flows at a flow velocity V1 obliquely to the plane orthogonal to the fan axial center CL. In addition, the flow velocity V1 of the backflow air in the intermediate gap 604*c* includes a radially outward velocity component V1*r* and a velocity component V1*a* directed to the other side of the fan axial center direction DRa.

As described above, according to the present embodiment, as illustrated in FIGS. 15 and 16, at the intermediate gap 604*c* which is a part of the fitting gap 604, the air flows at the flow velocity V1 including the velocity component V1*a* directed to the other side of the fan axial center direction DRa. Therefore, as compared with the labyrinth-esque structure of the fourth embodiment, the pressure loss when the backflow air passes through the fitting gap 604 can further increase.

In addition, in the present embodiment, effects similar to those of the fourth embodiment can be obtained from the configuration common to the above-described fourth embodiment.

Sixth Embodiment

Next, a sixth embodiment will be described. In the present embodiment, points different from the above-described third embodiment will mainly be described.

Even in the present embodiment, similar to the third embodiment, the outflow velocity when the side plate external air passes through the fitting gap 604 of the present embodiment and flows out to the inter-blade flow path 52*a*, is reduced as compared with a case where the air passes through the reference gap 604*z* of the comparative example illustrated in FIGS. 7 and 8 and flows out to the inter-blade flow path 52*a*. However, in the present embodiment, the shape of the fitting gap 604 is different from that of the third embodiment.

Figure 17:
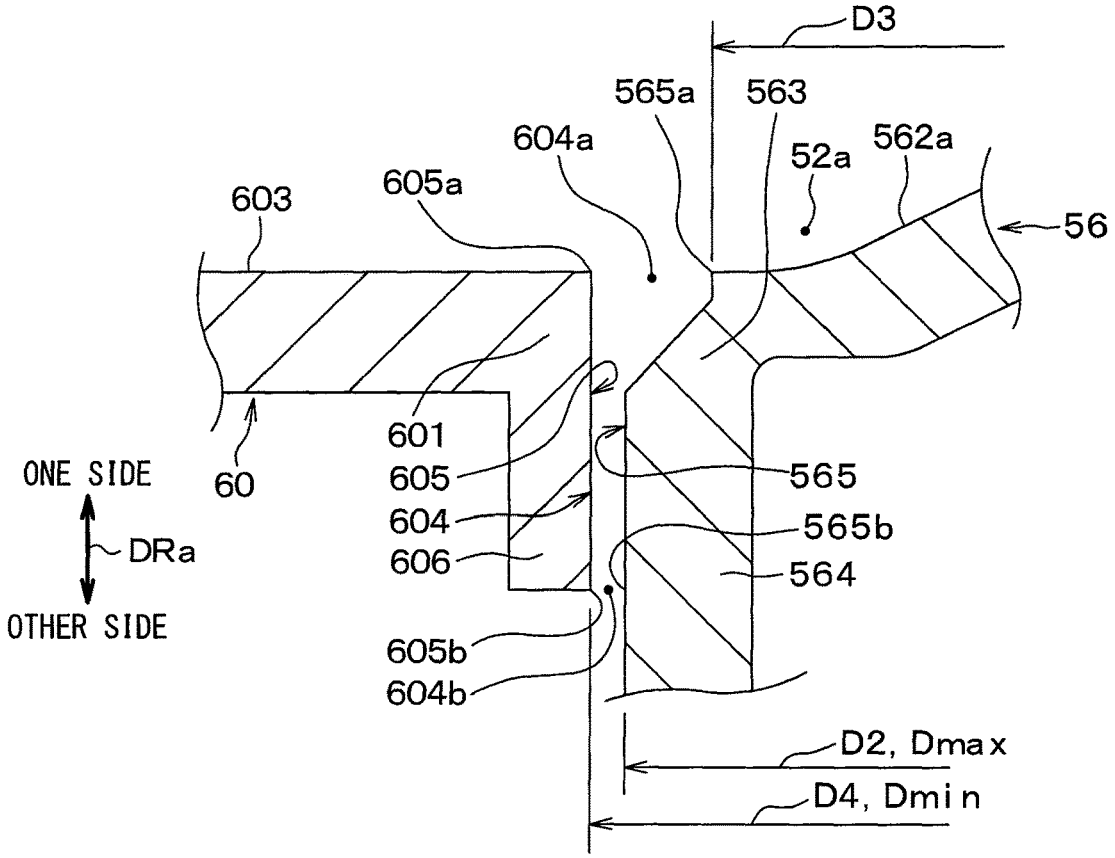
FIG. 17 is an enlarged detailed view of the portion VI of FIG. 5 in a sixth embodiment, and is a cross-sectional view that corresponds to FIG. 13 of the third embodiment.

Specifically, as illustrated in FIG. 17, the diameter of the hub fitting surface 565 decreases as approaching one side in the fan axial center direction DRa. In the present embodiment, the diameter of the hub fitting surface 565 is reduced in a stepwise manner. Therefore, the outer diameter D3 of the hub side one end forming portion 565*a* around the fan axial center CL is smaller than the outer diameter D2 of the hub side other end forming portion 565*b*. Therefore, the outer diameter D2 of the hub side other end forming portion 565*b* is the maximum outer diameter Dmax of the fan hub portion 56.

The spacing between the hub fitting surface 565 and the side plate fitting surface 605 in the fan radial direction DRr is widened as approaching the one side in the fan axial center direction DRa from the shape of the hub fitting surface 565 as described above.

Therefore, in the present embodiment, similar to the third embodiment, the passage length when the backflow air passes through the fitting gap 604 is longer than the passage length when the backflow air passes through the reference gap 604*z* of the comparative example. In addition to this, unlike the third embodiment, the passage cross-sectional area of the fitting gap 604 that serves as a passage through which the backflow air passes increases as approaching the inter-blade flow path 52*a*. A case where the fitting gap 604 is provided so as to reduce the above-described outflow velocity means that the fitting gap 604 is provided in this manner.

Therefore, by increasing the passage length of the fitting gap 604, similar to the third embodiment, the pressure loss when the backflow air passes through the fitting gap 604 can increase, and accordingly reducing the flow rate of the backflow air. In addition to this, in the present embodiment, by enlarging the passage cross-sectional area on the inter-blade flow path 52*a* side in the fitting gap 604, the outflow velocity when the backflow air flows out to the inter-blade flow path 52*a* can be reduced.

In addition, according to the present embodiment, the hub fitting surface 565 is formed with a diameter that increases in the fan axial center direction DRa as approaching the one side and the spacing between the hub fitting surface 565 and the side plate fitting surface 605 in the fan radial direction DRr increases as approaching the one side of the fan axial center direction DRa. Therefore, by enlarging the passage cross-sectional area of the fitting gap 604 on the inter-blade flow path 52*a* side, the outflow velocity when the backflow air flows out to the inter-blade flow path 52*a* can be reduced.

In addition, in the present embodiment, effects similar to those of the third embodiment can be obtained from the configuration common to the above-described third embodiment.

Other Embodiments (1) In the above-described sixth embodiment, the other end side plate 60 has the inner circumferential end protrusion portion 606, but this is an example. For example, it is also assumed that the inner circumferential end protrusion portion 606 is not provided and the passage length when the backflow air passes through the fitting gap 604 is the same as the passage length when the backflow air passes through the reference gap 604*z* of the comparative example. In short, the passage cross-sectional area of the fitting gap 604 that serves as a passage through which the backflow air passes may increase as approaching the inter-blade flow path 52*a*. Even in this case, by enlarging the passage cross-sectional area on the inter-blade flow path 52*a* side in the fitting gap 604, the outflow velocity when the backflow air flows out to the inter-blade flow path 52*a* can be reduced.

(2) In each of the above-described embodiments, the blade front edge 523 is configured such that the virtual tangent Ltg in FIG. 5 which is in contact with the blade front edge 523 is inclined with respect to the fan axial center CL, but the virtual tangent Ltg may be formed to be parallel to the fan axial center CL. In other words, since it is only necessary for the die for molding the fan main body member 50 to be pulled out in the fan axial center direction DRa, one side of the virtual tangent Ltg in the fan axial center direction DRa with respect to the fan axial center CL may not be inclined so as to face the inside of the fan radial direction DRr.

(3) In each of the above-described embodiments, the electric motor 16 is an outer rotor type brushless DC motor, but the motor type thereof is not limited. For example, the electric motor 16 may be an inner rotor type motor or a brushed type motor.

(4) In each of the above-described embodiments, as illustrated in FIG. 2, the annular extension portion 564 extends from the hub outer circumferential end portion 563 to the other side in the fan axial center direction DRa, but this is an example. For example, the annular extension portion 564 may extend from the portion further on the inside of the hub outer circumferential end portion 563 in the fan radial direction DRr to the other side in the fan axial center direction DRa. In addition, although the annular extension portion 564 is a cylindrical rib, the shape thereof is not limited. In addition, the fan hub portion 56 may not include the annular extension portion 564.

In addition, the present disclosure is not limited to the above-described embodiments. The present disclosure also encompasses various modifications or variations within the equivalent scope. In addition, in each of the above-described embodiments, it is needless to say that the elements which form the embodiment are not necessarily indispensable except in a case where the elements are clearly indispensable and a case where the elements are defined to be obviously indispensable in principle. In addition, in each of the above-described embodiments, when numerical values, such as the number, the numerical value, the quantity, the range, and the like of the component elements of the embodiment are mentioned, the values are not limited to a specific number except in a case where it is clearly stated that the values are particularly indispensable and in a case where the values are clearly limited to a specific number in principle. In addition, when referring to the materials, shapes, positional relationships, and the like of the component elements in each of the above-described embodiments, the material, the shape, the positional relationship, and the like are not limited except in a case where the values are particularly clearly stated and in a case where the values are limited to a specific material, shape, positional relationship, and the like in principle.

(Overview)

According to a first viewpoint described in a part or the entirety of each of the above-described embodiments, the fitting gap is formed such that the outflow velocity when the air on a side opposite from the inter-blade flow path side with respect to the other end side plate passes through the fitting gap and outflows to the inter-blade flow path is reduced as compared with the outflow velocity when the air passes through the reference gap and outflows to the inter-blade flow path.

In addition, according to a second viewpoint, a case where the fitting gap is provided so as to reduce the above-described outflow velocity means that the fitting gap is formed such that the passage length when the air passes through the fitting gap is longer than the passage length when the air passes through the reference gap. Therefore, by increasing the pressure loss when the air passes through the fitting gap, the flow rate of the air (that is, flow rate of the backflow air) can be reduced. At the same time, the air flow from the other end side plate due to the air inflow can be prevented from the fitting gap to the inter-blade flow path from being separated. As a result, the air volume of the turbofan 18 can increase and noise can be reduced.

In addition, according to a third viewpoint, a case where the fitting gap is provided so as to reduce the above-described outflow velocity means that the fitting gap is formed such that the passage cross-sectional area of the fitting gap that serves as a passage through which the air passes increases as approaching the inter-blade flow path. Therefore, by enlarging the passage cross-sectional area on the inter-blade flow path side in the fitting gap, the outflow velocity when the backflow air flows out to the inter-blade flow path can be reduced.

In addition, according to a fourth viewpoint, a case where the fitting gap is provided so as to reduce the above-described outflow velocity means that the fitting gap is formed such that the passage length when the air passes through the fitting gap is longer than the passage length when the air passes through the reference gap, and the passage cross-sectional area of the fitting gap which serves as a passage through which the air passes increases as approaching the inter-blade flow path. Therefore, by increasing the pressure loss when the backflow air passes through the fitting gap, the flow rate of the backflow air can be reduced. In addition to this, by enlarging the passage cross-sectional area on the inter-blade flow path side in the fitting gap, the outflow velocity when the backflow air flows out to the inter-blade flow path can be reduced.

Further, according to a fifth viewpoint, the hub side one end forming portion is formed such that the outer diameter of the hub side one end forming portion is larger than the outer diameter of the hub side other end forming portion. Therefore, as compared with a case where the fitting gap simply extends in the axial direction similar to the above-described reference gap, it is easy to ensure a long passage length of the fitting gap that serves as an air passage. Accordingly, the pressure loss when the backflow air passes through the fitting gap can increase.

In addition, according to a sixth viewpoint, the minimum inner diameter of the side plate fitting surface is smaller than the outer diameter of the hub side one end forming portion. Therefore, the passage width of the fitting gap can be narrowed while ensuring a long passage length of the fitting gap. Accordingly, the pressure loss when the backflow air passes through the fitting gap can increase.

Further, according to a seventh viewpoint, the diameter of the hub inclined surface increases as approaching one side in the axial direction. Therefore, the direction of the air flow when flowing from the fitting gap to the inter-blade flow path can be made easy to follow the air flow directed radially outward in the inter-blade flow path. According to this, it is possible to obtain an effect of preventing the air flow from being separated from the other end side plate. Therefore, the air volume of the turbofan 18 can increase and noise can be reduced.

In addition, according to an eighth viewpoint, the side plate inclined surface is formed to have a diameter which increases in the axial direction as approaching the one side, and formed such that the spacing between the side plate inclined surface and the hub inclined surface in the radial direction increases as approaching the one side. Therefore, the passage length of the fitting gap can be made longer than the above-described reference gap, and the passage cross-sectional area of the fitting gap can be enlarged at the inter-blade flow path side. Accordingly, it is necessary to realize the reduction of the flow rate of the backflow air due to an increase in pressure loss of the fitting gap and the reduction of the outflow velocity of the backflow air due to the increase in passage cross-sectional area on the inter-blade flow path side in the fitting gap.

In addition, according to a ninth viewpoint, the fitting gap is formed such that the cross-sectional shape of the fitting gap in the cross-section including the fan axial center has a crank shape. Therefore, the fitting gap can be provided with a labyrinth-esque structure. In addition, according to the present embodiment, the pressure loss when the backflow air passes through the fitting gap by the labyrinth-esque structure can increase, and accordingly reducing the flow rate of the backflow air.

In addition, according to a tenth viewpoint, the fitting gap has the intermediate gap which is a part of the fitting gap, and in the intermediate gap, the air flows at a velocity including a velocity component directed to the other side in the axial direction. Therefore, as compared with a case where the flow velocity of the backflow air that flows through the intermediate gap does not include the velocity component directed to the other side in the axial direction, the pressure loss when the backflow air passes through the fitting gap can increase.

In addition, according to an eleventh viewpoint, the hub fitting surface is formed to have a diameter which decreases in the axial direction as approaching the one side, and formed such that the spacing between the hub fitting surface and the side plate fitting surface in the radial direction increases as approaching the axial one side. Therefore, by enlarging the passage cross-sectional area of the fitting gap on the inter-blade flow path side, the outflow velocity when the backflow air flows out to the inter-blade flow path can be reduced.

In addition, according to a twelfth viewpoint, the width of the fitting gap in the axial direction is larger than the axial thickness. Therefore, a long passage length of the fitting gap can be ensured, and the pressure loss when the backflow air passes through the fitting gap can increase. As a result, the flow rate of the backflow air that passes through the fitting gap can be reduced, the air volume of the turbofan can increase, and noise can be reduced.

Further, according to a thirteenth viewpoint, the inner circumferential end protrusion portion is provided in a tubular shape over the entire circumference around the fan axial center. Therefore, as compared with a case where the inner circumferential end protrusion portion does not extend over the entire circumference, the pressure loss when the backflow air passes through the fitting gap can increase. In other words, the action of reducing the flow rate of the backflow air which passes through the fitting gap can increase.

In addition, according to a fourteenth viewpoint, the maximum outer diameter of the fan hub portion is smaller than the minimum inner diameter of the shroud ring. Therefore, the multiple blades, the shroud ring, and the fan hub portion can be easily integrally molded with the axial direction of the fan axial center as an extraction direction (that is, an opening and closing direction of the dies) of the dies.

What is claimed is:

1. A turbofan which is applied to a blower and which blows air by rotating about a fan axial center, comprising:

a fan main body member including a plurality of blades disposed around the fan axial center, a shroud ring having formed therein an intake hole into which air is suctioned, the shroud ring being provided on one side in an axial direction of the fan axial center with respect to the plurality of blades and being coupled to each of the plurality of blades, and a fan hub portion which is supported so as to be rotatable about the fan axial center with respect to a non-rotating member of the blower and which is coupled to each of the plurality of blades on a side opposite from the shroud ring; and an other end side plate that, in a state of being fitted to a radially outer side of the fan hub portion, is joined to an other side blade end portion included in each of the plurality of blades, the other side blade end portions of the plurality of blades being on an other side which is opposite to the one side in the axial direction, wherein the plurality of blades form an inter-blade flow path, through which air flows, between adjacent ones of the plurality of blades, the other end side plate forms a fitting gap between the other end side plate and the fan hub portion in a radial direction of the fan axial center, the fitting gap includes an end gap portion which is an end portion of the fitting gap at the one side in the axial direction, and the fan main body member and the other end side plate are formed such that the end gap portion extends at an angle greater than 0 degrees and less than 90 degrees with respect to the axial direction, assuming a virtual reference gap that corresponds to the fitting gap, in which:

a length of the reference gap in the axial direction is defined as an axial thickness of the other end side plate in the axial direction, a passage cross-sectional area of the reference gap as a passage through which air passes is constant at any location in the axial direction and equal to a minimum passage cross-sectional area of the fitting gap in the axial direction, and a cross-sectional shape of the reference gap in a cross-section orthogonal to the fan axial center is uniform at any location in the axial direction, then:

the fitting gap is formed such that an outflow velocity of air on a side opposite from the inter-blade flow path with respect to the other end side plate passes through the fitting gap to outflow to the inter-blade flow path is reduced as compared with an outflow velocity when the air passes through the reference gap to outflow to the inter-blade flow path.

2. The turbofan according to claim 1, wherein the fitting gap is formed such that a passage length for air passing through the fitting gap is longer than a passage for air passing through the reference gap, thereby reducing the outflow velocity of air passing through the fitting gap to outflow to the inter-blade flow path as compared with the outflow velocity of air passing through the reference gap to outflow to the inter-blade flow path.

3. The turbofan according to claim 1, wherein the fitting gap is provided such that the passage cross-sectional area of the fitting gap that serves as a passage through which air passes increases as approaching the inter-blade flow path, thereby reducing the outflow velocity of air passing through the fitting gap to outflow to the inter-blade flow path as compared with the outflow velocity of air passing through the reference gap to outflow to the inter-blade flow path.

4. The turbofan according to claim 1, wherein the fitting gap is formed such that a passage length for air passing through the fitting gap is longer than a passage for air passing through the reference gap, and such that the passage cross-sectional area of the fitting gap that serves as a passage through which air passes increases as approaching the inter-blade flow path, thereby reducing the outflow velocity of air passing through the fitting gap to outflow to the inter-blade flow path as compared with the outflow velocity of air passing through the reference gap to outflow to the inter-blade flow path.

5. The turbofan according to claim 1, wherein the fitting gap has a gap one end positioned on the one side in the axial direction and a gap other end positioned on the other side in the axial direction, wherein the fan hub portion has a hub fitting surface which faces the fitting gap, wherein the hub fitting surface includes a hub side one end forming portion which forms the gap one end, and a hub side other end forming portion which forms the gap other end, and wherein the hub side one end forming portion is provided such that an outer diameter of the hub side one end forming portion is greater than an outer diameter of the hub side other end forming portion.

6. The turbofan according to claim 5, wherein the other end side plate has a side plate fitting surface which faces the fitting gap, the side plate fitting surface is provided such that an inner diameter of the side plate fitting surface is smallest at a position on the other side in the axial direction as compared to the hub side one end forming portion, and a minimum inner diameter of the side plate fitting surface is smaller than the outer diameter of the hub side one end forming portion.

7. The turbofan according to claim 6, wherein the hub fitting surface includes a hub inclined surface which extends from the hub side one end forming portion to the other side in the axial direction and is inclined with respect to the fan axial center, and the hub inclined surface is formed to have a diameter which increases as approaching the one side in the axial direction.

8. The turbofan according to claim 7, wherein the side plate fitting surface includes a side plate side one end forming portion which forms the gap one end, and a side plate inclined surface which extends to the other side in the axial direction from the side plate side one end forming portion and is inclined with respect to the fan axial center, and the side plate inclined surface is formed to have a diameter which increases as approaching the one side in the axial direction, and formed such that a spacing between the side plate inclined surface and the hub inclined surface in the radial direction increases as approaching the one side.

9. The turbofan according to claim 5, wherein the fitting gap is formed such that a cross-sectional shape of the fitting gap in a cross-section including the fan axial center is crank shaped.

10. The turbofan according to claim 9, wherein the fitting gap has an intermediate gap as a portion of the fitting gap, and in the intermediate gap, air flows at a flow velocity including a velocity component directed toward the other side in the axial direction.

11. The turbofan according to claim 1, wherein the other end side plate has a side plate fitting surface which faces the fitting gap, the fan hub portion has a hub fitting surface which faces the fitting gap, and the hub fitting surface is formed to have a diameter which decreases as approaching the one side in the axial direction, and formed such that a spacing between the hub fitting surface and the side plate fitting surface in the radial direction increases as approaching the one side.

12. The turbofan according to claim 1, wherein the other end side plate includes a side plate inner circumferential end portion which is provided on an inner side of the other end side plate in the radial direction, and an inner circumferential end protrusion portion which protrudes from the side plate inner circumferential end portion toward the other side in the axial direction, the inner circumferential end protrusion portion faces the fitting gap on an inside of the inner circumferential end protrusion portion in the radial direction, and a width of the fitting gap in the axial direction is greater than the axial thickness.

13. The turbofan according to claim 12, wherein the inner circumferential end protrusion portion is provided in a tubular shape over an entire circumference around the fan axial center.

14. The turbofan according to claim 1, wherein a maximum outer diameter of the fan hub portion is smaller than a minimum inner diameter of the shroud ring.

15. The turbofan according to claim 1, wherein the fan main body member and the other end side plate are formed such that the end gap portion extends at an angle greater than 10 degrees and less than 80 degrees with respect to the axial direction.

* * * * *